US006682180B2

(12) United States Patent
Sakamoto et al.

(10) Patent No.: US 6,682,180 B2
(45) Date of Patent: Jan. 27, 2004

(54) INK JET HEAD AND PRINTING APPARATUS

(75) Inventors: Yoshiaki Sakamoto, Kawasaki (JP); Shuji Koike, Tokyo (JP); Tomohisa Shingai, Kawasaki (JP); Toshihiko Osada, Kawasaki (JP); Seigen Otani, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 10/163,611

(22) Filed: Jun. 7, 2002

(65) Prior Publication Data

US 2002/0154198 A1 Oct. 24, 2002

Related U.S. Application Data

(63) Continuation of application No. PCT/JP99/06960, filed on Dec. 10, 1999.

(51) Int. Cl.[7] ..... B41J 2/045
(52) U.S. Cl. ..... 347/70
(58) Field of Search ..... 347/68–72, 84–86

(56) References Cited

U.S. PATENT DOCUMENTS

| | | | | |
|---|---|---|---|---|
| 4,633,274 | A | 12/1986 | Matsuda | |
| 5,929,881 | A | 7/1999 | Kitahara et al. | |
| 6,471,342 | B1 * | 10/2002 | Horio et al. | 347/70 |

FOREIGN PATENT DOCUMENTS

| | | | |
|---|---|---|---|
| EP | 0 220 959 | A3 | 5/1987 |
| EP | 723 867 | A3 | 8/1996 |
| EP | 860 280 | A2 | 8/1998 |
| JP | 59-176549 | | 11/1984 |
| JP | 2-143861 | | 6/1990 |
| JP | 6-99580 | | 4/1994 |
| JP | 9-300630 | | 11/1997 |
| JP | 10-128973 | | 5/1998 |
| JP | 10-202876 | | 8/1998 |
| JP | 11-157070 | | 6/1999 |
| JP | 11-179903 | | 7/1999 |
| JP | 2000-117990 | | 4/2000 |

* cited by examiner

*Primary Examiner*—Stephen D. Meier
*Assistant Examiner*—An H. Do
(74) *Attorney, Agent, or Firm*—Armstrong, Kratz, Quintos, Hanson & Brooks, LLP

(57) ABSTRACT

An ink jet head having a plurality of nozzles discharging ink supplied from an ink supply unit. The ink jet head includes a head main body including a plurality of pressure chambers (112) provided for the respective nozzles, in which ink is filled, and a plurality of pressure units provided for the respective pressure chambers (112), each of the pressure units applying pressure to the pressure chamber (112) to discharge the ink in the pressure chamber (112) from the nozzle, an individual electrode (109) provided for each of the pressure units to drive the pressure unit, at least one contact (121) connected to an external connection wiring member supplying a signal for controlling the pressure unit, and a wiring pattern (123) formed into a thin film to electrically connect the individual electrode (109) to the contact (121), thereby facilitating connection to the external connection wiring member, improving the fabrication efficiency and the reliability.

23 Claims, 28 Drawing Sheets

INK JET HEAD AND PRINTING APPARATUS

This application is a continuation of international application PCT/JP99/06960 filed on Dec. 10, 1999.

TECHNICAL FIELD

The present invention relates to an ink jet head having a plurality of nozzles which discharge ink supplied from an ink supply unit, that is, an ink jet head suitable for use in a print head of an ink jet printer, for example, and a printer apparatus having the ink jet head.

BACKGROUND ART

The ink jet printer is a printer apparatus in a system that discharges drops of ink from an ink jet head having a plurality of nozzles to make to directly adhere the ink drops to a recording medium such as a printing paper or the like. For instance, the ink jet printer prints on a printing paper by conveying the printing paper in a direction perpendicular to a direction of moving the ink jet head while reciprocally moving the ink jet head in a direction of the width of the printing paper.

FIGS. 34 and 35 are diagrams illustrating the structure of a known ink jet head. FIG. 34 is an exploded perspective view for illustrating the structures of essential parts of a known ink jet head disclosed in Japanese Patent Laid-Open Publication No. H6-99580. FIG. 35 is a diagram for illustrating a wiring method in the ink jet head.

The known ink jet head is disclosed in, for example, Japanese Patent Laid-Open Publication No. H6-99580, which comprises a nozzle plate 310 in which a plurality (64 in the drawing) of nozzles 312 are cut and formed, and a substrate 311 having a plurality (64 in the drawing) of ink chambers 313 formed correspondingly to the respective nozzles 312, as shown in FIGS. 34 and 35.

In the substrate 311 formed are an ink supply port 318 which communicates with an ink tank not shown, and ink supply channels 314 which link and connect the ink supply port 318 to ink chambers 313.

The nozzle plate 310 is adhered to a surface on a side (the upper side in FIG. 34) where the ink chambers 313 on the substrate 311 are formed. By adhering the nozzle plate 310 to the substrate 311, ink can be filled inside each of the ink chambers 313 and the ink supply channels 314. The ink supplied from the ink tank can be thereby supplied to each of the ink chambers 313 through the ink supply channel 314.

In the substrate 311, a surface of each of the ink chambers 313 opposite to the nozzle plate 310 is formed by a vibrating plate not shown, so that each of the ink chambers 313 is formed as a space sandwiched between the vibrating plate and the nozzle plate 310. A peizoelectric element 315 is disposed on the opposite side (the lower side in FIG. 34) of each of the vibrating plates to the ink chamber 313. The vibrating plate and the piezoelectric elements 315 form a bimorph layered body.

An individual electrode (not shown) is formed on a surface (the lower side in FIG. 34) of each of the piezoelectric elements 315 opposite to the vibrating plate. The individual electrodes are electrically connected to FPCs (Flexible Printed Circuit Boards) 316A through 316D by wire bonding using wires 317. Incidentally, the above vibrating plate is made of a member having conductivity, as well.

Each of the FPCs 316A through 316D is connected to a printing signal generator through a connector or the like not shown. A printing signal is transmitted from the printing signal generator to each of the individual electrodes and the vibrating plates, so that each of the piezoelectric elements 315 applies pressure to the ink chamber 313, and ink is discharged from each of the nozzles 312.

Since the individual electrode of each of the piezoelectric elements 315 is connected to the FPC 316A, 316B, . . . , 316D or by wire bonding using the wire 317 in the known ink jet head, it is necessary to secure a space to wire the wire 317 by wire-bonding on the upper side of each of the individual electrodes, that is, on the opposite side to a surface of the substrate 311 to which the nozzle plate 310 are adhered. This leads to problems that the packaging density of the nozzles 312 cannot be increased, and the size of the ink jet head cannot be decreased.

Since the wires 317 are connected by air wiring (wire bonding), short circuit might occur between the wires 317, and the piezoelectric element 315 or the like might be damaged when each of the piezoelectric elements 315 and the FPC 316A, 316B, . . . , or 316D are connected by wire bonding.

In the ink jet head in a multiple nozzle structure having plural rows of nozzles, it is necessary to form a row of electric contacts for each row of the nozzles (individual electrodes), and to connect the wires 317 for each row of the electric contacts. This leads to a low fabrication efficiency of the ink jet head.

Further, the wire bonding has a limitation of reduction the contact pitch. For example, when the contact pitch is not larger than about 60 $\mu$m (not less than 450 dpi as a nozzle pitch), the fabrication stability might decrease in case of mass production.

A method of directly soldering the FPCs 316A through 316D to the individual electrodes is also generally known, which has the similar problems that the above method employing wire bonding has.

In the light of the above problems, objects of the present invention are to facilitate connecting to external connection wiring members, to improve the fabrication efficiency and the reliability, and to decrease the size of the ink jet head and the printer apparatus.

DISCLOSURE OF THE INVENTION

The present invention therefore provides an ink jet head having a plurality of nozzles discharging ink supplied from an ink supply unit comprising a head main body including a plurality of pressure chambers provided for the nozzles, respectively, in which ink is filled, and a plurality of pressure units provided for the pressure chambers, respectively, each of the pressure units applying pressure to the pressure chamber to discharge the ink in the pressure chamber from the nozzle, an individual electrode provided for each of the pressure units to drive the pressure unit, at least one contact connected to an external connection wiring member supplying a signal for controlling the pressure unit, and a wiring pattern formed into a thin film to electrically connect the individual electrode to the contact.

Accordingly, each of the individual electrodes and the external connection wiring member can be electrically connected readily, which improves the fabrication efficiency of the ink jet head. Further, the individual electrode and the contact can be electrically connected certainly, which improves the reliability. Still further, a space for wire bonding (air wiring) becomes unnecessary, which allows reduction of the size of the ink jet head and the printing apparatus.

Since a wiring pattern electrically connecting the individual electrode to the contact is formed into a thin film, a space above the individual electrode for laying a wire connecting the individual electrode to the external connection wiring member becomes unnecessary. Hence, freedom can be given to the shape of the ink jet head, and the size of the ink jet head can be reduced.

The individual electrode, the contact and the wiring pattern may be integrally formed into a thin film on the same surface from the same material. This allows the ink jet head to be fabricated at a low cost and readily.

The ink jet head may further comprise a joint formed to project from the head main body so that the ink supply unit is mounted to the head main body. It is thereby possible to mount the ink supply unit to the head main body readily and certainly, and improve the rigidity of the head main body.

The head main body may be formed on a substrate, and the joint may be formed as a remaining part of the substrate on the head main body by partially removing the substrate from the head main body. It is thereby possible to form the joint readily and certainly in the course of substrate forming, thus the fabrication cost can be decreased.

The joint may be formed to enclose the individual electrodes on a surface on which the individual electrodes, the contacts and the wiring patterns are formed, and the contacts may be disposed outside the joint. Alternatively, the joint may be formed to enclose the individual electrodes on a surface on which the individual electrodes are formed, and to project outward from a periphery of the head main body, and the contacts may be arranged outside the periphery of the head main body on the side of the joint. It is thereby possible to increase the rigidity of the head main body, and readily connect the external connection wiring member to the contacts.

The joint may function as a positioning unit positioning the external connection wiring member to the contact. It is thereby possible to certainly connect the external connection wiring member to the contact, and improve the reliability.

Positioning of the external connection wiring member to the contact may be performed by fitting an end surface of the external connection wiring member to an outer peripheral surface of the joint. It is thereby possible to certainly position the external connection wiring member to the contact.

A positioning unit for positioning the external connection wiring member to the contact may be formed as a remaining part of the substrate on the head main body by partially removing the substrate from the head main body. It is thereby possible to certainly position the external connection wiring member to the contact, and readily form the positioning unit.

Positioning of the external connection wiring member to the contact may be performed by fitting the positioning unit into at least one positioning hole formed on the side of the external connection wiring member. It is thereby possible to certainly position the external connection wiring member to the contact.

The external connection wiring member may be an FPC (Flexible Printed Circuit Board), and may be electrically connected to the contact by the use of a TAB (Tape Automated Bonding) technique. The pressure unit may comprise the individual electrode, a vibrating plate forming a part of the pressure chamber and a piezoelectric element driving the vibrating plate to apply pressure to the pressure chamber. It is thereby possible to certainly realize the present invention.

The present invention also provides a printing apparatus comprising an ink jet head having a plurality of nozzles discharging ink supplied from an ink supply unit comprising the ink jet head including a head main body including a plurality of pressure chambers provided for the nozzles, respectively, in which ink is filled, and a plurality of pressure units provided for the pressure chambers, respectively, each of the pressure units applying pressure to the pressure chamber to discharge the ink in the pressure chamber from the nozzle, an individual electrode provided for each of the pressure units to drive the pressure unit, at least one contact connected to an external connection wiring member supplying a signal for controlling the pressure unit, and a wiring pattern formed into a thin film to electrically connect the individual electrode to the contact.

Accordingly, each of the individual electrodes and the external connection wiring member can be electrically connected readily, which allows improvement of the fabrication efficiency of the printing apparatus. Each of the individual electrodes and the contact can be electrically connected certainly, which allows improvement of the reliability. Since a space for wire bonding (air wiring) becomes unnecessary, the size of the printing apparatus can be reduced.

BRIEF DESCRIPTION OF DRAWINGS

FIG. 19(*b*) is a perspective view showing the structure of a head main body of the ink jet head according to the third modification of the first embodiment of this invention;

BEST MODE FOR CARRYING OUT THE INVENTION

(A) Description of First Embodiment

Hereinafter, description will be made of embodiments of this invention with reference to the drawings.

Figure 1:
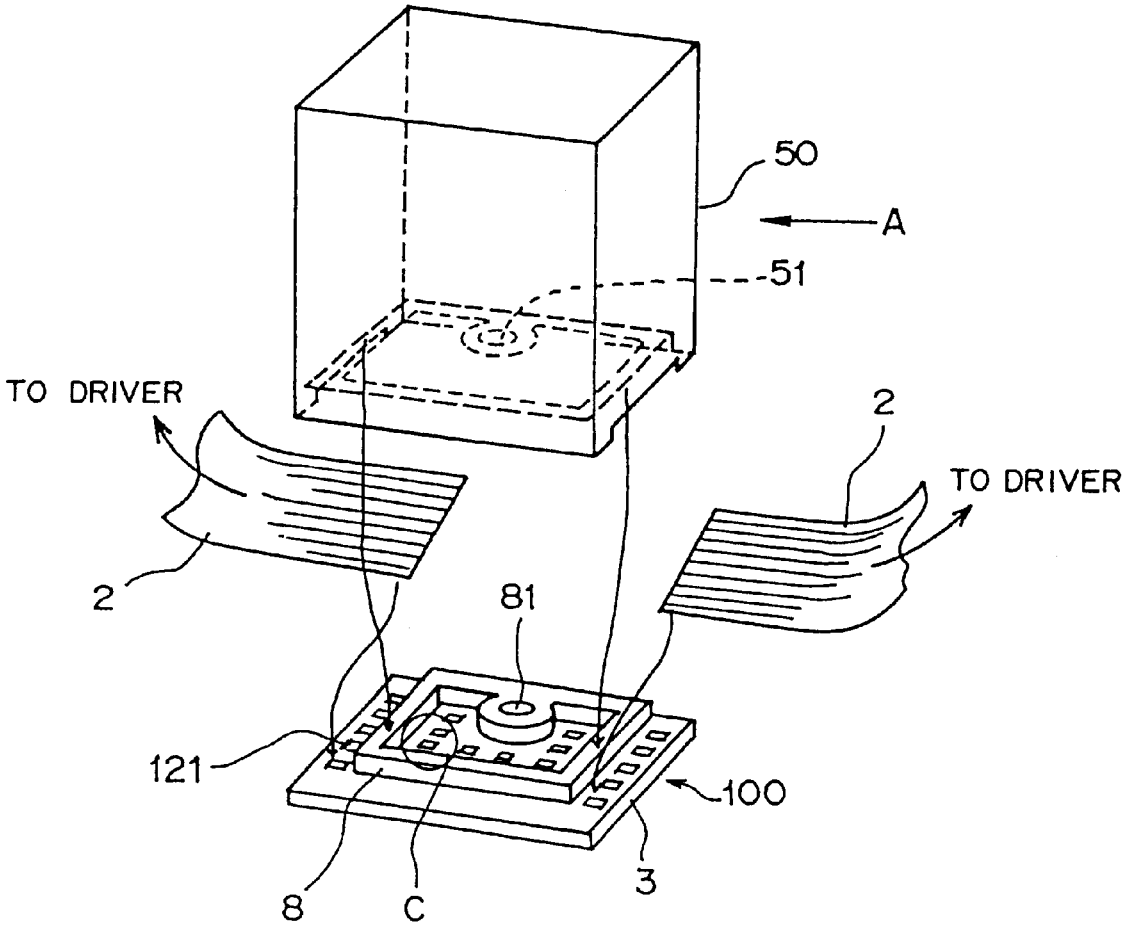
FIG. 1 is an exploded perspective view showing the whole structure of an ink jet head according to a first embodiment of this invention.
Figure 2:
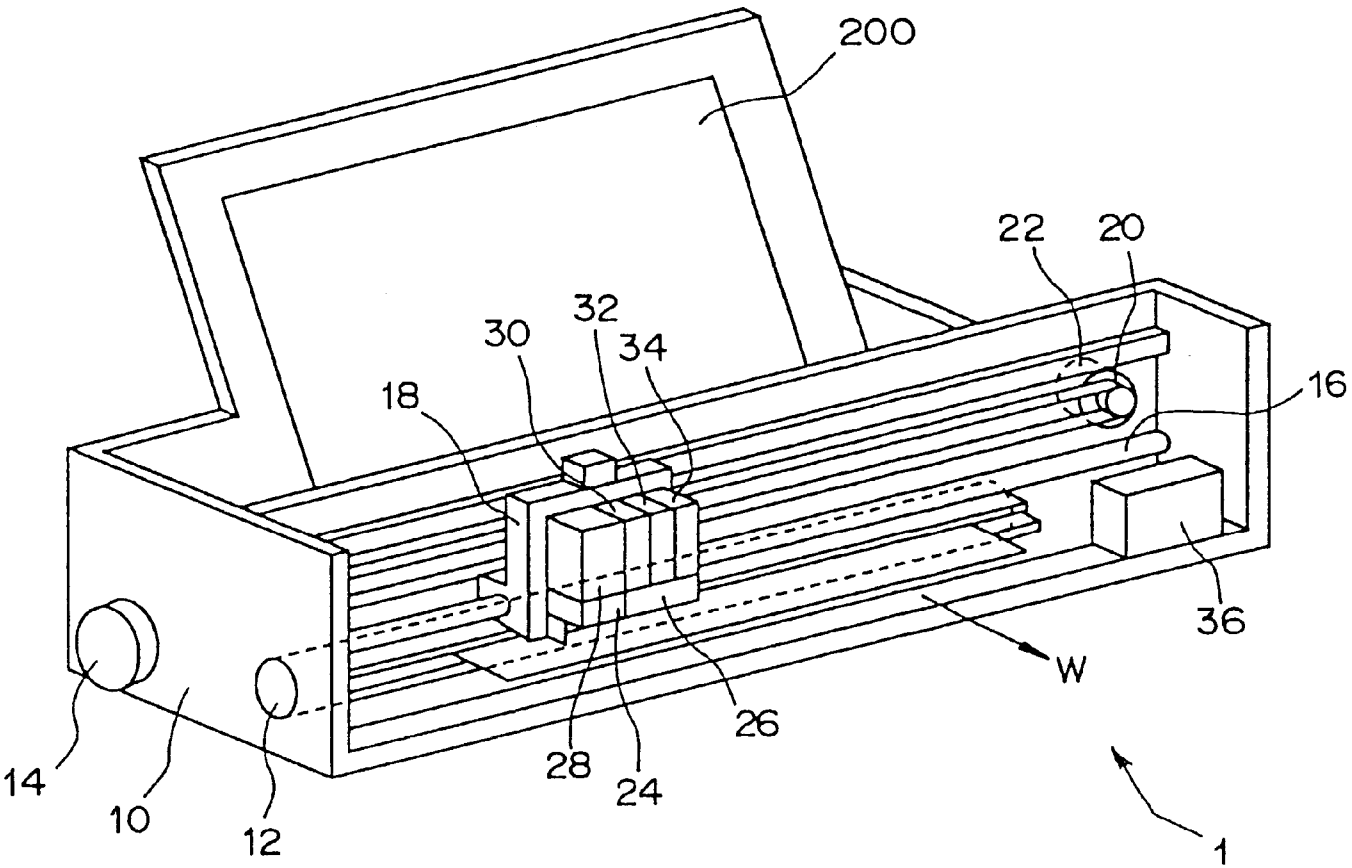
FIG. 2 is a perspective view showing the structure of an ink jet printer having the ink jet head.

FIG. 1 is a exploded perspective view showing the whole structure of an ink jet head according to a first embodiment of this invention. FIG. 2 is a perspective view showing the structure of an ink jet printer having the ink jet head according to the first embodiment of this invention.

The ink jet printer 1 is a printer apparatus which discharges ink onto a printing paper 200 to form an image on its surface. The ink jet printer 1 comprises a platen 12, a carriage 18, a nozzle maintenance mechanism 36, an ink jet head units 24 and 26, and ink tanks 28, 30, 32 and 34 inside a housing 10.

The platen 12 is rotatably attached to the housing 10, perpendicular to a direction that the printing paper 200 is conveyed in this ink jet printer 1. The platen 12 is intermittently driven to be rotated by a drive motor 14, thereby intermittently conveying the printing paper 200 at a predetermined feed pitch in a direction shown by an arrow W in FIG. 2.

Above the platen 12 in the housing 10 disposed is a guide rod 16 in parallel to the platen 12, and the carriage 18 is slidably mounted on the guide rod 16.

The carriage 18 is attached to an endless drive belt 20 disposed in parallel to the guide rod 16, and the endless drive belt 20 is driven by the drive motor 22. Whereby, the carriage 18 reciprocally moves along the platen 12. The ink jet units 24 and 26 are detachably attached to the carriage 18.

In the ink head units 24 and 26, the ink tanks 28, 30, 32 and 34 are mounted on the respective ink jet heads 100. The ink tank 28 in which black-colored ink is filled is attached to the ink jet head unit 24. To the ink jet head unit 26 attached are the ink tank 30 in which yellow ink is filled, the ink tank 32 in which magenta ink is filled and the ink tank 34 in which cyan ink is filled.

While the carriage 18 is reciprocally moved along the platen 12, the ink jet head units 24 and 26 are driven on the basis of image data obtained from an upper apparatus such as a personal computer or the like not shown, predetermined characters, images or the like are formed on the printing paper 200 and printing is performed.

When the printing is stopped, the carriage 18 (the ink jet heads 24 and 26) is moved to a position (home position) at which the nozzle maintenance mechanism 36 is disposed.

The nozzle maintenance mechanism 36 comprises a movable suction cap (not shown) and a suction pump (not shown) connected to the movable suction cap. When the ink jet head units 24 and 26 are moved to the home position, the suction cap sticks to nozzle plates (to be described later) of the ink jet head units 24 and 26, the suction pump is driven, and the nozzles of the nozzle plates are sucked, whereby clog of the nozzles can be beforehand prevented.

Next, the structure of the ink jet head 100 according to the first embodiment of this invention will be described with reference to FIGS. 1, and 3 through 7.

Figure 3:
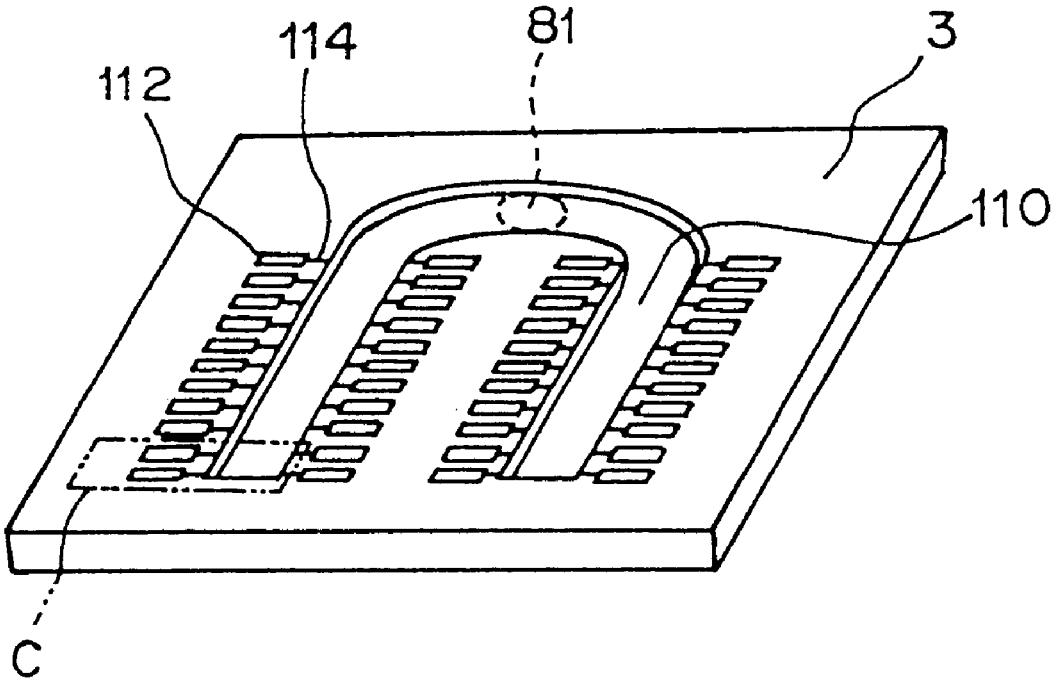
FIG. 3 is a perspective view showing a horizontal sectional view of a head main body shown in FIG. 1 in order to illustrate the structure of the head main body of the ink jet head according to the first embodiment.
Figure 4:
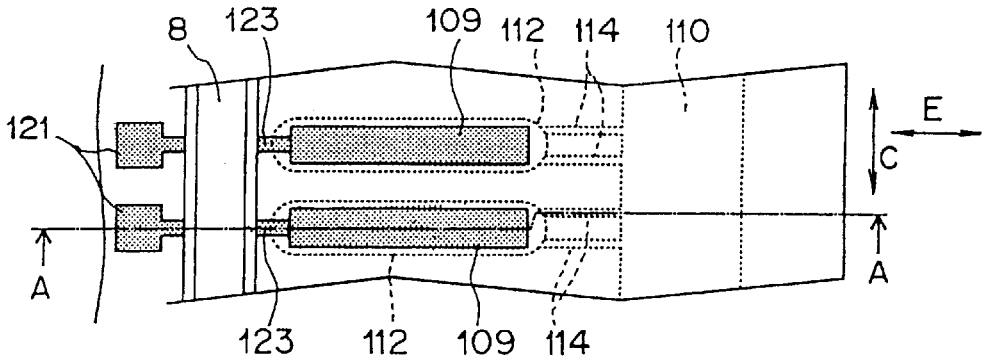
FIG. 4 is an enlarged plan view of C portion in FIG. 1.
Figure 5:
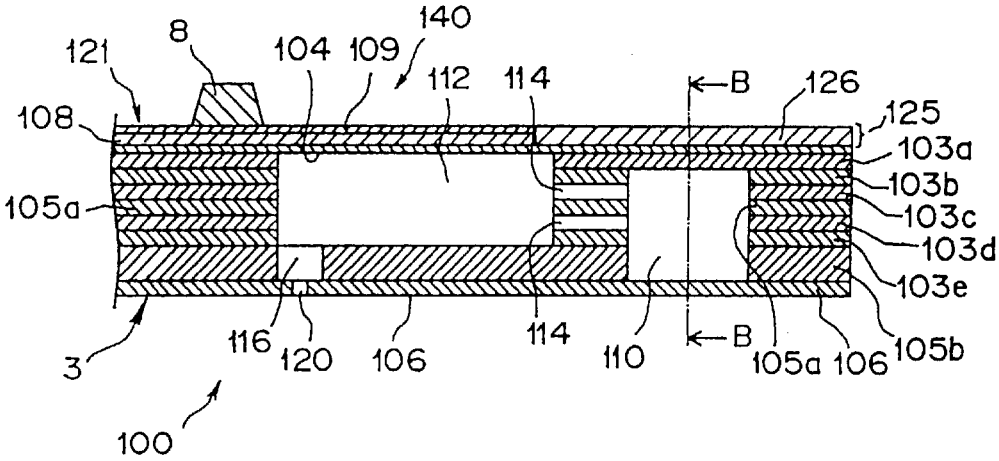
FIG. 5 is a cross sectional view taken along line A—A in FIG. 4.
Figure 6:
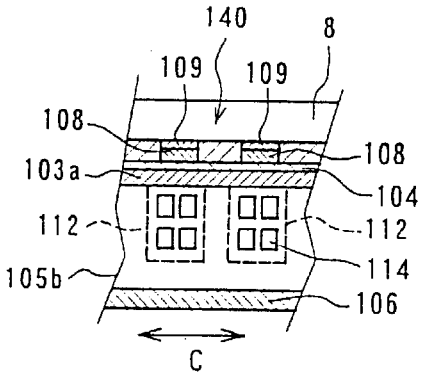
FIG. 6 is a cross sectional view taken along line B—B in FIG. 5.
Figure 7:
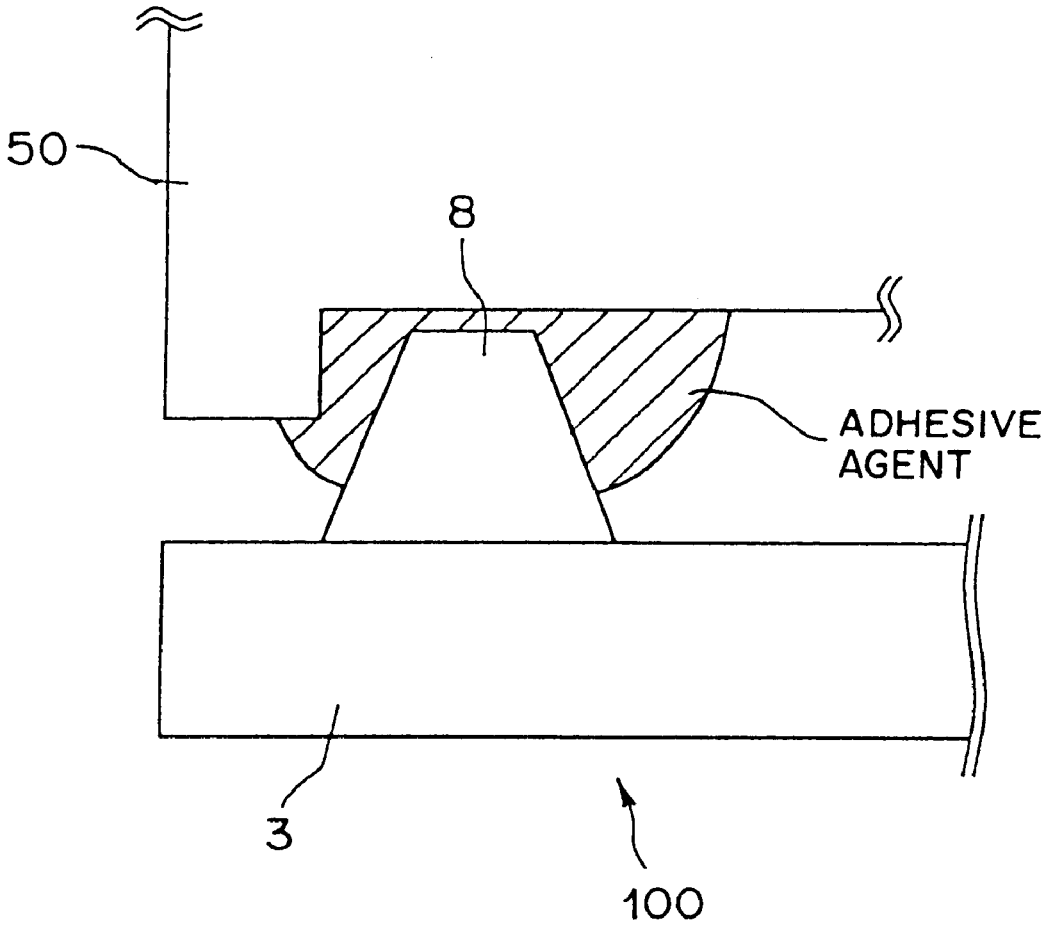
FIG. 7 is a cross sectional view showing a joint of the ink jet head according to the first embodiment of this invention.

FIG. 3 is a perspective view showing a horizontal cross section of a head main body shown in FIG. 1 in order to illustrate the internal structure of the head main body of the ink jet head according to the first embodiment of this invention. FIG. 4 is an enlarged diagram of C portion in FIG. 1. FIG. 5 is a cross sectional view taken along line A—A in FIG. 4. FIG. 6 is a cross sectional view taken along line B—B in FIG. 5. FIG. 7 is a cross sectional view showing a joint of the head main body.

The ink jet head 100 according to the first embodiment has a plurality of nozzles 120 (refer to FIG. 5) discharging ink supplied from an ink tank (ink supply unit) 50, which comprises a head main body 3 and a joint 8.

The head main body 3 has, in its inside, an ink common channel 110, along with a pressure chamber 112, a pressure unit 140 and an ink supply channels 114 for each of the plural nozzles 120, as shown in FIGS. 4 through 6.

The head main body 3 of the ink jet head 100 according to the first embodiment is formed, as shown in FIG. 5, by laying a plurality of layers of dry film resists 103*a* through 103*e*, a vibrating plate 104, stainless steel plates 105*a* and 105*b*, a polyimide film 126, an individual electrode 109, a nozzle plate 106, etc. one on another. The production process by laying layers will be described later.

The pressure chamber 112 is to be filled ink therein, linked and connected to the nozzle 120 through a conduit 116.

The pressure unit 140 applies pressure to the pressure chamber 112 to discharge ink in the pressure chamber 112 from the nozzle 120. The pressure unit 140 comprises the vibrating plate 104 and a piezoelectric element 108.

The vibrating plate 104 is made of, for example, an elastic deformable metal thin film (of a thickness of about several $\mu$m) of chromium, nickel or the like, which has conductivity and some degree of rigidity. The vibrating plate 104 forms a part of the pressure chamber 112, concretely, a surface opposite to a surface on which the conduit 116 is formed in the pressure chamber 112.

The thin-film-like piezoelectric element 108 is formed on the opposite surface of the vibrating plate 104 to the pressure chamber 112. The piezoelectric element 108 is made of piezoelectric ceramics or the like. The vibrating plate 104 and the piezoelectric element 108 form a bimorph layered body.

The individual electrode 109 is formed on the opposite surface of the piezoelectric element 108 to the vibrating plate 104. A drive signal is supplied from a drive circuit not shown to the vibrating plate 104 and the individual electrode 109 to deform the piezoelectric element 108 in each of the pressure units 140, thereby applying pressure to the pressure chamber 112. Namely, each of the pressure chambers 112 has the individual electrode 109 for driving a corresponding pressure unit 140.

The ink supply channels 114 are to supply ink supplied from the ink tank 50 to the pressure chamber 112, which link and connect the ink common channel 110 to be described later to the pressure chamber 112. The ink supply channels 14 are formed for each of the pressure chambers 112 in the first embodiment.

Meanwhile, the number of the ink supply channels 114 and positions at which the ink supply channels 114 are arranged are not limited to this example, but may be modified in various ways without departing from the scope of the invention.

The ink common channel 110 is configured as a U-shaped space formed inside the head main body 3, as shown in FIG. 3. The ink common channel 110 is linked and connected to a link channel 81 at almost the center position thereof. The ink common channel 110 is also linked and connected to the ink supply channels 114 and an ink supply port 51 of the ink tank 50.

The fluid resistance of ink in the ink common channel 110 and the ink supply channels 114 is adjusted so that rapid internal pressure fluctuations in the pressure chamber 112 are absorbed. After the pressure chamber 112 is applied pressure and is contracted, and discharges the ink, a necessary quantity of ink is supplied to the pressure chamber 112 through the ink supply channels 114 when the pressure chamber 112 restores. Incidentally, supply of the ink is performed, based on adjustment of the fluid resistance of the ink.

A plurality of the pressure chambers 112 are arranged to the ink common channel 110 like branches. Each of the pressure chambers 112 and the ink common channel 110 are linked and connected through the above-described ink supply channels 114.

Incidentally, the pressure chambers 112 are disposed so as to be aligned in a direction indicated by arrow C in FIGS. 4 and 6.

The joint 8 is formed to project from a surface opposite to the surface on which the nozzle 120 of the head main body 3 is formed (on the side on which the individual electrode 109 of the head main body 3 is formed). The joint 8 is formed so as to enclose the individual electrodes 109 on the surface on which the individual electrodes 109 of the head main body 3 are formed.

Namely, the joint 8 is formed so as to enclose the individual electrodes 109 on a surface on which the individual electrodes 109, contacts (to be described later) and wire patterns (to be described later) are formed.

The joint 8 is formed as a remaining part on a substrate on the head main body 3 by partially removing the substrate made of magnesium oxide (MgO) by photo-etching, as will be described later. As shown in FIG. 7, by mounting the ink tank (an ink supply unit) 50 on the joint 8 using an adhesive agent or the like, the ink tank 50 (an ink tank fixing member) is mounted on the head main body 3.

Note that what is mounted on the joint 8 is not limited to the ink tank 50 described above, but a member (the ink tank fixing member; not shown) may be detachably mounted on the joint 8, for example.

As shown in FIGS. 5 and 7, the joint 8 has a cross-sectional shape the width of which becomes narrower as the height increases. Whereby, the adhesive agent forced out from the adhering surface to the ink tank 50 or the like can be held by the slopes of the joint 8, it is thus possible to prevent the adhesive agent forced out from reaching the head main body 3.

A plurality of the contacts 121 are formed on the surface on which the individual electrodes 109 of the head main body 3 are formed, in the vicinity of the outer periphery of the head main body 3, concretely, outside the joint 8.

The contact 121 is formed for each of the individual electrodes 109. The contact 121 and the individual electrode 109 are electrically connected to each other by a wiring pattern 123 formed into a thin film.

These contacts 121 are electrically connected to FPCs (Flexible Printed Circuit Boards: external connection wiring members) supplying signals to control the pressure units 140 using a TAB (Tape Automated Bonding) technique.

Meanwhile, a polyimide film 126 is disposed in an area on the vibrating plate 104, in which the piezoelecric element 108 and the individual electrode 109 are absent, to electrically insulate.

Next, description will be made of the shape of the wiring pattern 123 for electrically connecting the individual electrode 109 to the contact 121 with reference to FIGS. 8 through 10.

Figure 8:
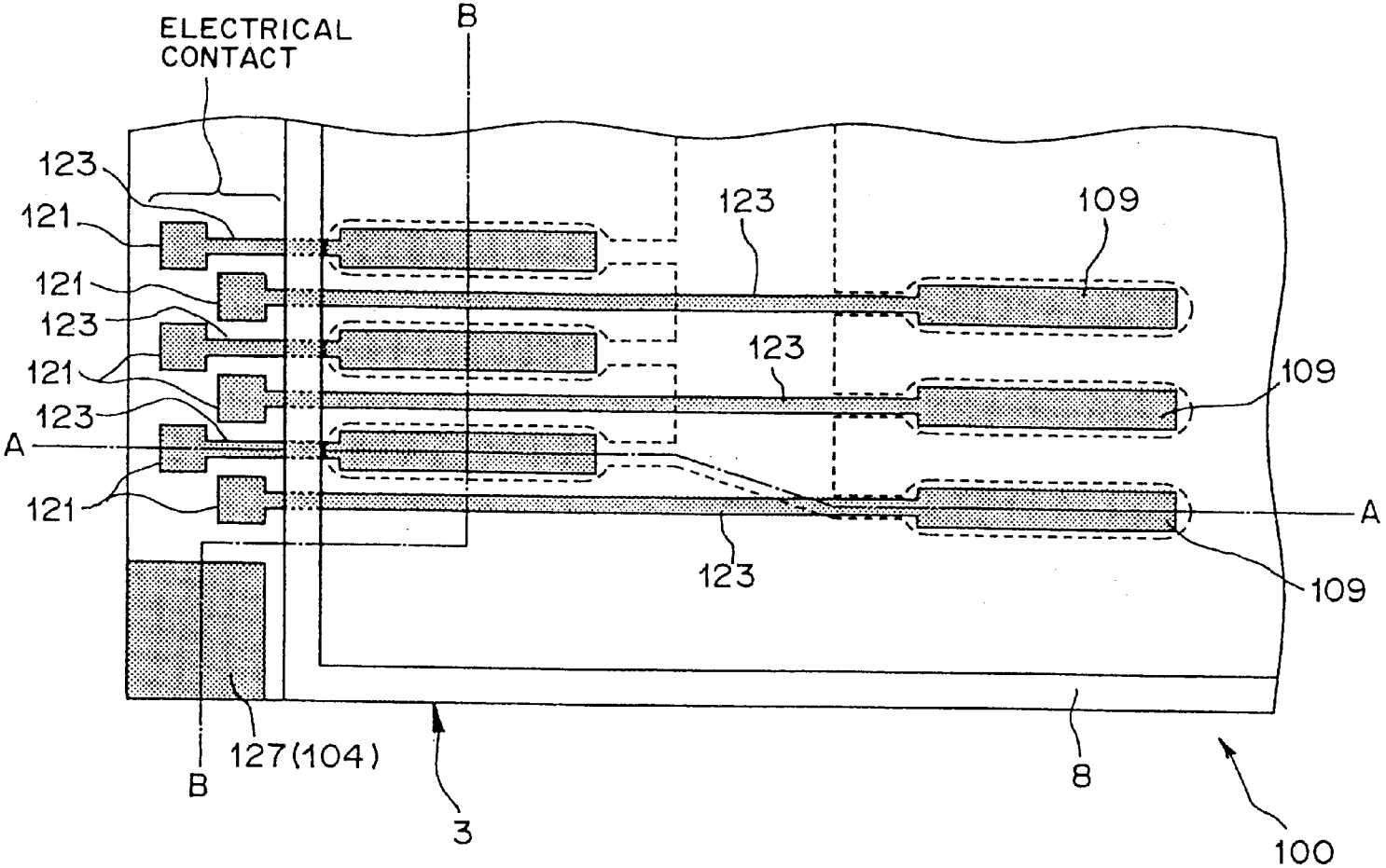
FIG. 8 is an enlarged plan view of essential parts of wiring patterns of the ink jet head according to the first embodiment of this invention.
Figure 9:
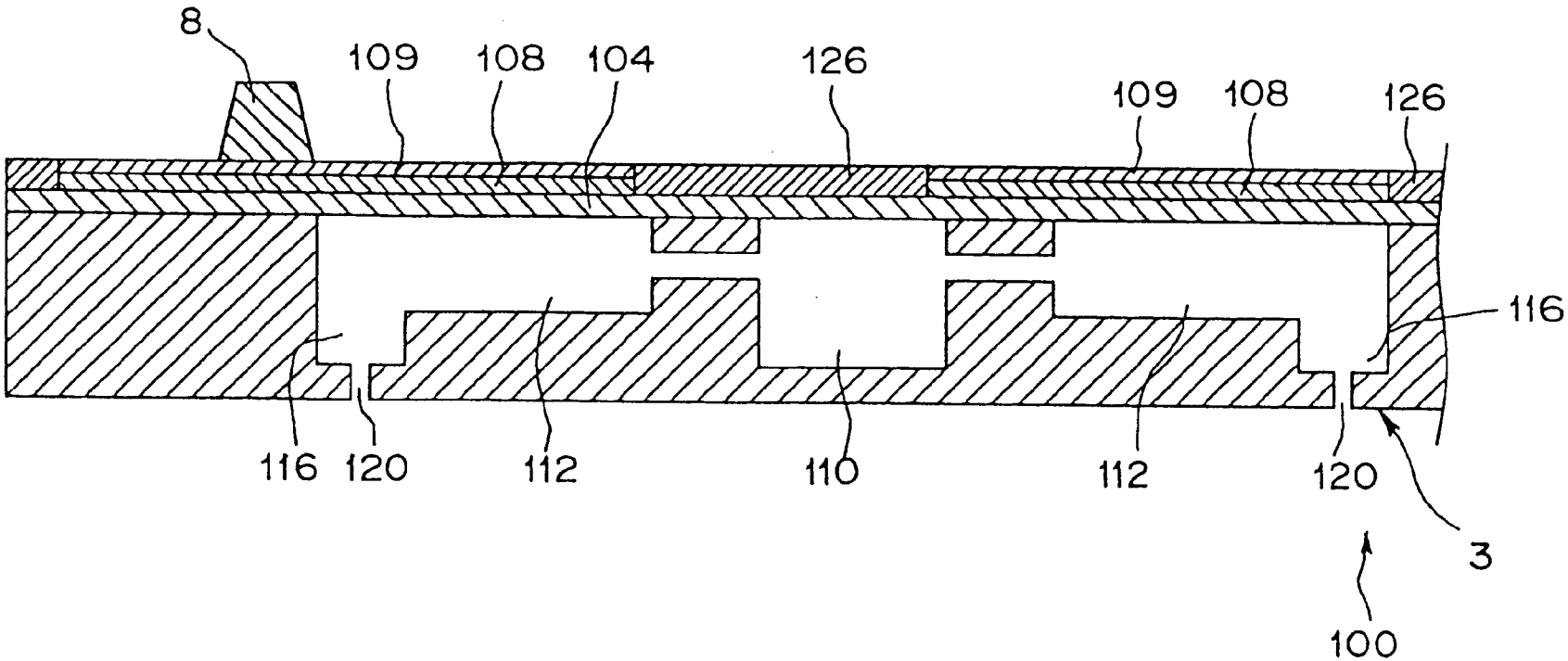
FIG. 9 is a cross sectional view taken along line A—A in FIG. 8.
Figure 10:
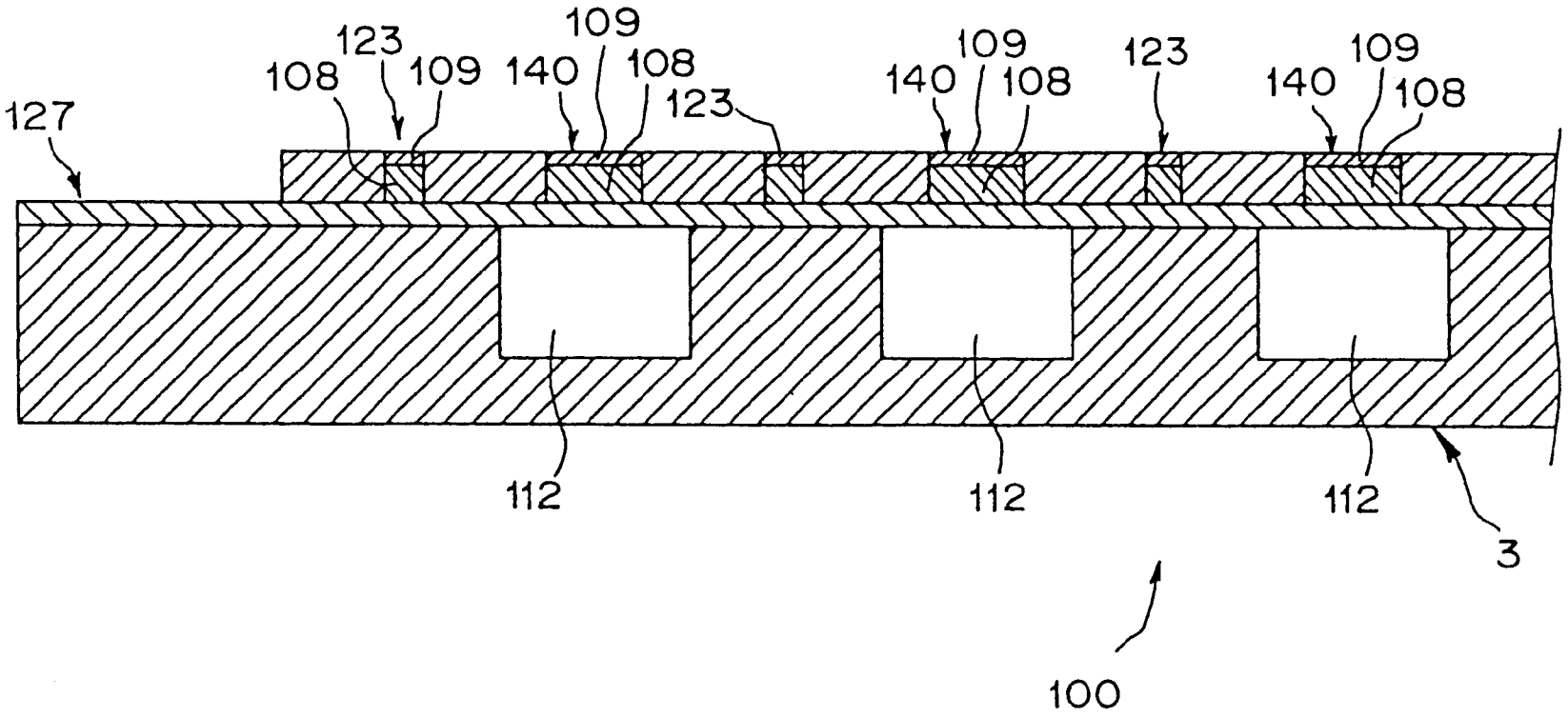
FIG. 10 is a cross sectional view taken along line B—B in FIG. 8.

FIGS. 8 through 10 are diagrams for illustrating the shape of each wiring pattern 123.

FIG. 8 is an enlarged plan view of essential parts of the wiring patterns of the ink jet head according to the first embodiment. FIG. 9 is a cross sectional view taken along line A—A in FIG. 8. FIG. 10 is a cross sectional view taken along line B—B in FIG. 8.

In FIGS. 9 and 10, illustration of the layered structure configured with the dry film resists 103*a* through 103*e*, the stainless steel plates 105*a* and 105*b*, etc. is omitted, for the sake of convenience.

As shown in FIG. 8, the contacts 121 are formed on the surface on which the individual electrodes 109 of the head main body 3 are formed, outside (on the peripheral side) of the joint 8. The contact 121 and the individual electrode 109 are electrically connected to each other by the wiring pattern 123.

The wiring pattern 123 is formed together with the individual electrode 109 and the contact 121 on the head main body 3 by patterning, as will be described later. Accordingly, the wiring pattern 123 is formed integrally with the individual electrode 109 and the contact 121 on the same surface of the same material into a thin film.

As shown in FIGS. 8 through 10, the wiring pattern 123 is laid approximately in parallel to a longitudinal direction (in the right-to-left direction in FIG. 8) of each of the individual electrodes 109, and passes between the individual electrodes 109 (the pressure chambers 112). Further, the wiring pattern 123 is disposed so as to pass under the joint 8, that is, between the head main body 3 and the joint 8, as shown in FIG. 9.

In the head main body 3, the vibrating plate 104 is exposed on the surface on which the individual electrodes 109, etc. of the main body 3 are formed, outside the joint 8, in the vicinity of a corner of the head main body 3, thereby forming a contact 127.

The FPC 2 is electrically connected to the contacts 121 and 127 using a technique such as TAB or the like. Even when the ink tank 50 (the ink tank fixing member) is mounted on the joint 8 as shown in FIG. 7, each of the individual electrodes 109 and the vibrating plates 104 can be connected to the FPC 2 supplying a signal for controlling the pressure unit 140 without an effect of it.

The contact 127 is lower then other contacts 121 by a thickness of the piezoelectric elements 108 and the individual electrodes 109. However, this exerts no effect when the FPC 2 and the like is contact-bonded and connected because the thickness of the piezoelectric element 108 is about 2 to 3 $\mu$m and the thickness of the individual electrode 109 is about 0.2 $\mu$m, which are sufficiently thin.

Figure 11:
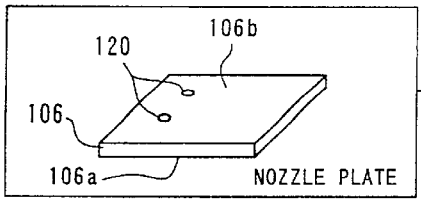
FIG. 11 is a diagram for illustrating a method of fabricating the ink jet head according to the first embodiment of this invention.
Figure 11:
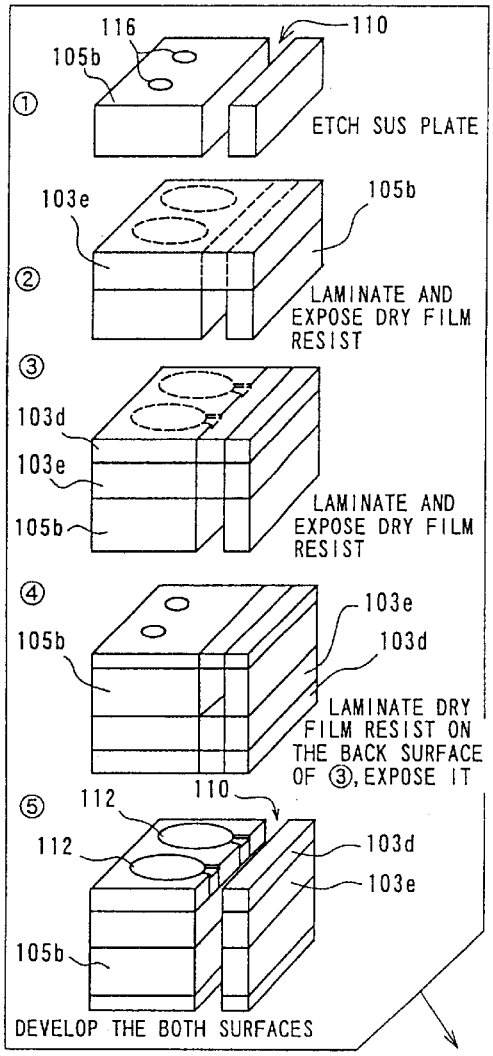
Figure 11:
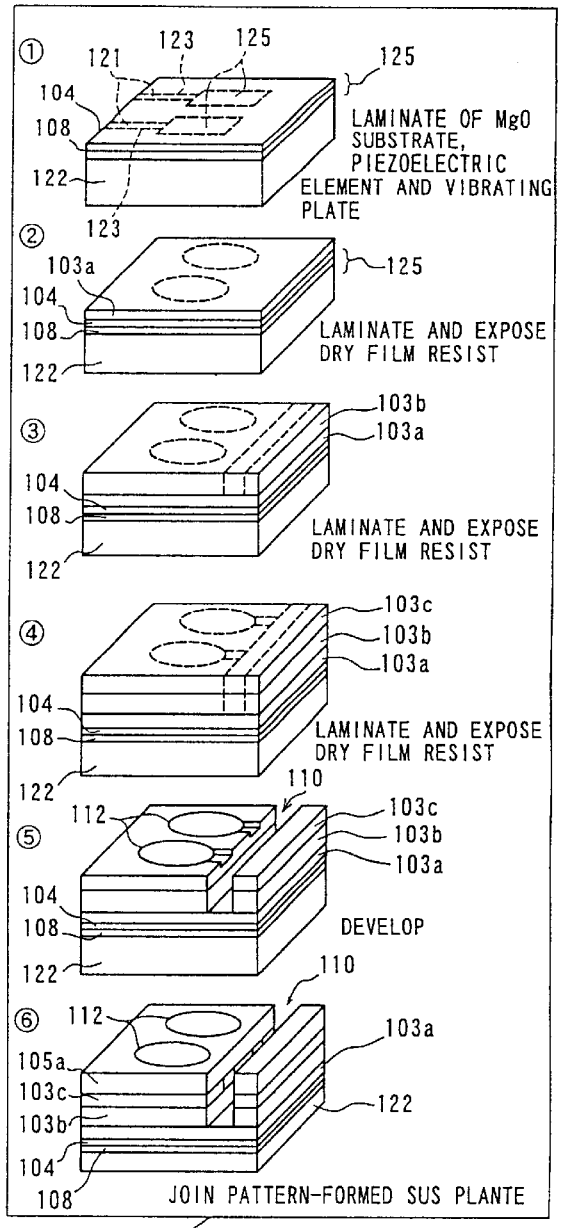
Figure 11:
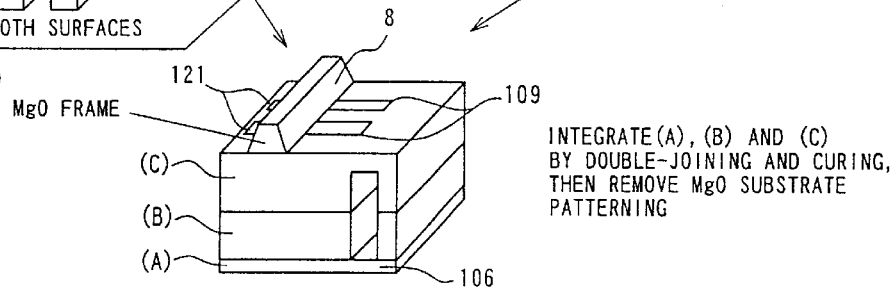
Figure 12:
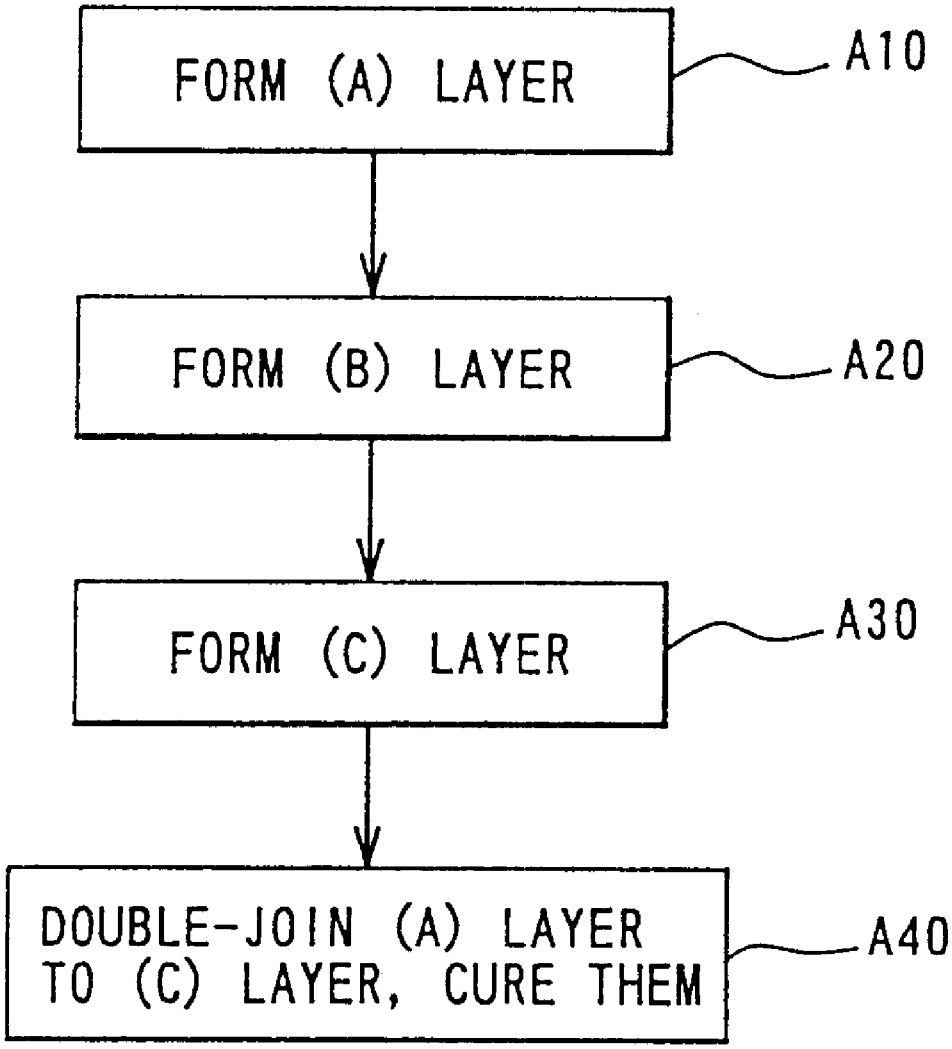
FIGS. 12 through 14 are flowcharts for illustrating the method of fabricating the ink jet head according to the first embodiment of this invention.
Figure 13:
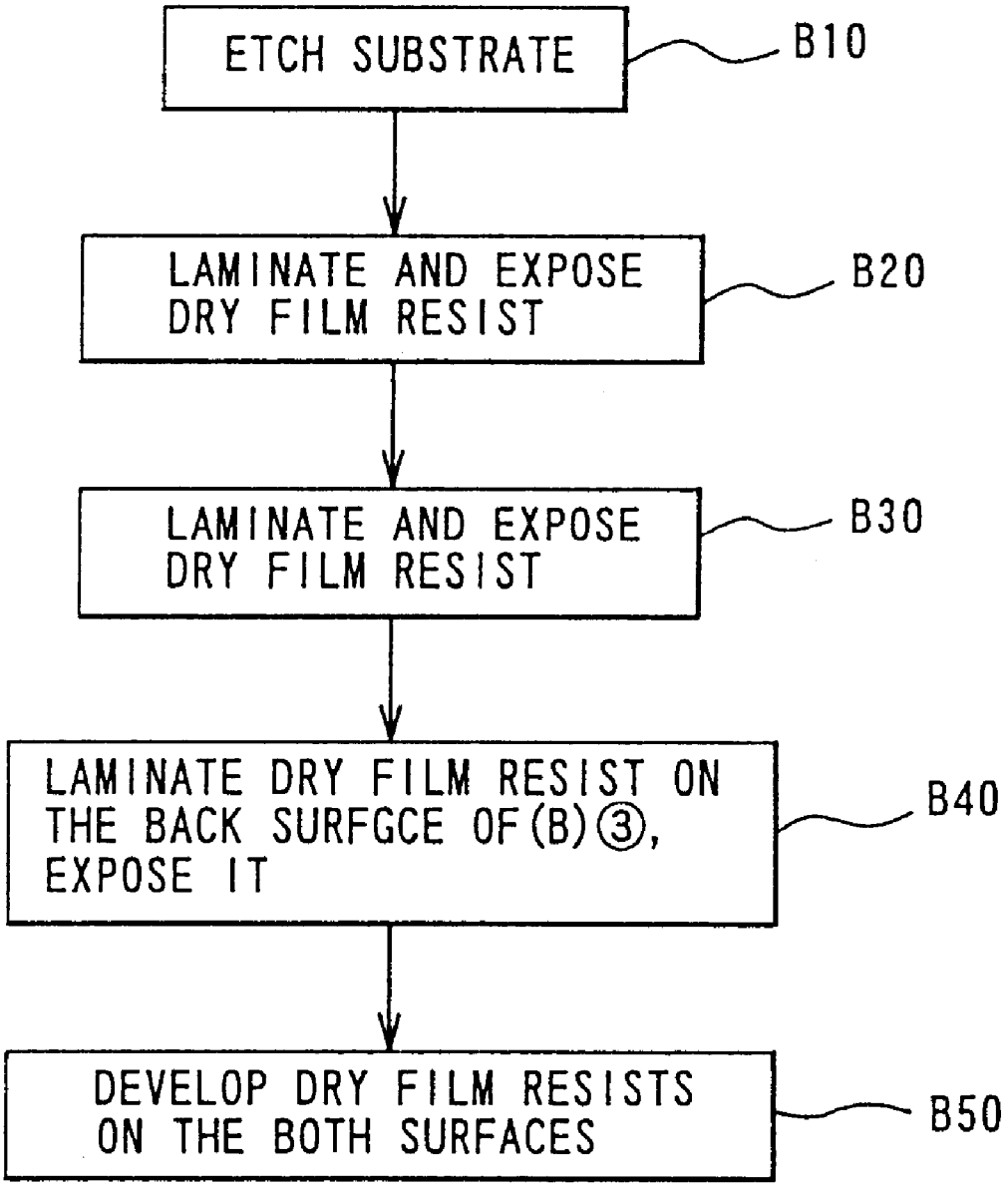
Figure 14:
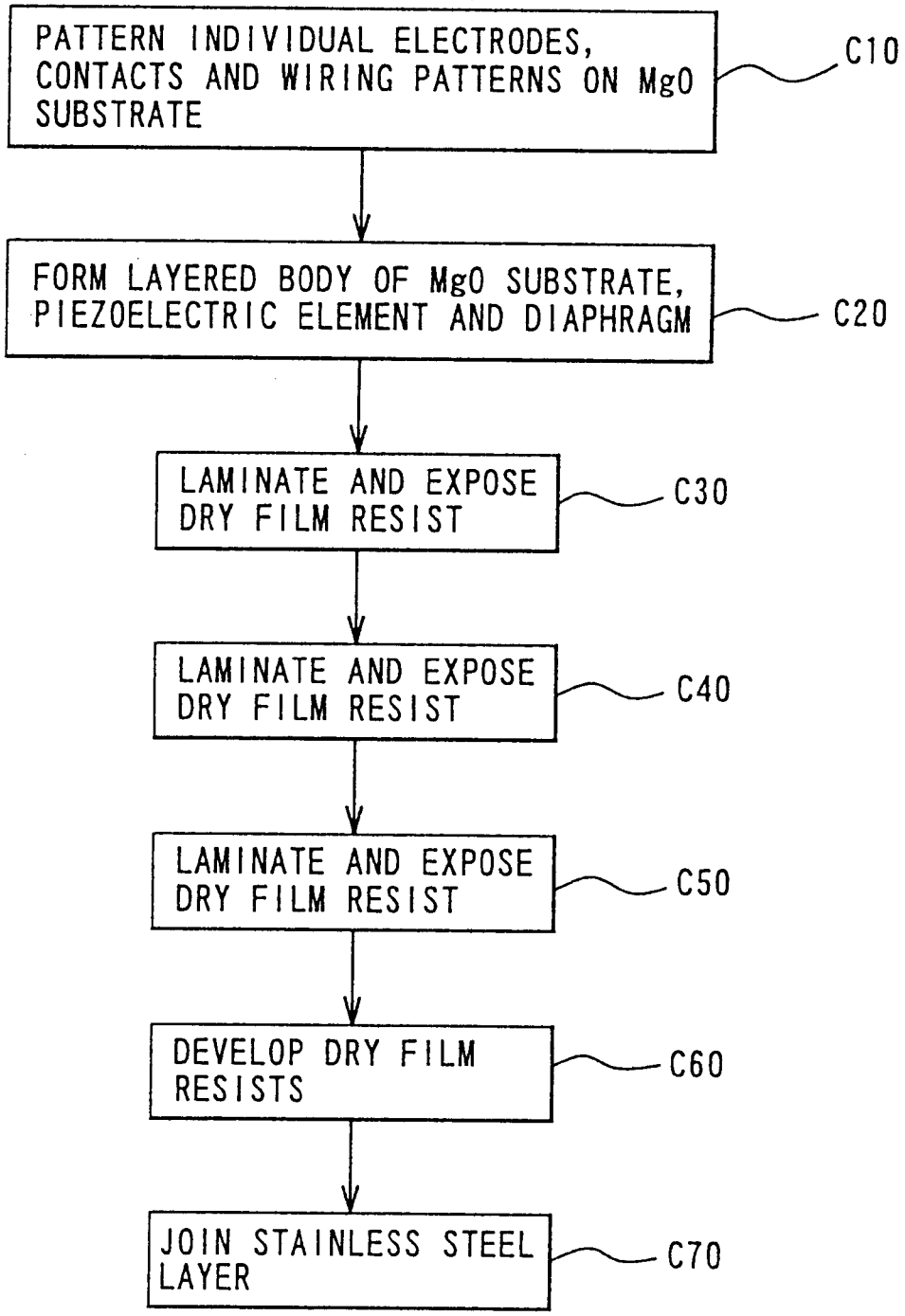

Next, description will be made of a method of fabricating the ink jet head according to this invention with reference to FIGS. 11 through 11. FIG. 11 is a diagram for illustrating a method of fabricating the ink jet head according to the first embodiment. FIGS. 12 through 14 are flowcharts for illustrating the fabricating method.

The ink jet head 100 according to the first embodiment is manufactured using the patterning technique with dry film resists, by separately forming the three layers, heating them at about 150° C., double-joining, and curing them (steps A10 through A40 in FIG. 12). Incidentally, FIG. 11 shows only neighboring two pressure chambers for the sake of convenience. The process at each of steps A1 through A40 shown in FIG. 12 may be performed in prior to other step, or may be performed in parallel.

First, as shown in FIGS. 11(A) and 5, the nozzle plate 106 ((A) layer) in which the nozzles 120 are formed is formed of a metal such as stainless steel or the like by the micro press forming (STEP A10). Each of the nozzles 120 is preferably processed into a cone shape (tapered in section) using a punch with a pin (not shown) or the like, which preferably extends from the front surface 106*a* on the nozzle plate 106 to its back surface 106*b* (to be joined to the stainless steel plate 105*b*).

The stainless plate 105*b* and the nozzle plate 106 are not integrally configured, but the nozzle plate 106 is joined to the stainless plate 105*b,* whereby the cone-sheped nozzle 120 can be formed.

Next, as shown in FIG. 11(B), dry film resists and the stainless steel plate 105*b* are laminated to form (B) layer (step A20 in FIG. 12). In more detail, the (B) layer is formed according to steps B10 through B50 shown in FIG. 13.

First, as shown at ① in FIG. 11(B), the stainless steel plate 105*b* having rigidity is etched to form the conduits 116 and the ink common channel 110 (STEP B10 in FIG. 13). Incidentally, an apparatus and the like required for etching are obvious to those skilled in the art, thus detailed description of which are omitted.

Next, as shown at ② in FIG. 11(B), the dry film resist 103 (corresponding to the dry film resist 103*e* in FIG. 5) of the first layer is laminated on the stainless steel plate 105*b,* and portions corresponding to the pressure chambers 112 and the ink common channel 110 are exposed in the-masking process (STEP B20 in FIG. 13).

Incidentally, laminating of the dry film resist and an apparatus for realizing exposure of the same are obvious to those skilled in the art, thus detailed descriptions of which are omitted.

When the dry film resist 103 is used, it is preferable that a member having rigidity (for example, the stainless steel plate 105*b,* the nozzle plate 106, the MgO substrate 122, or the like) is used as a substrate, and the dry film resist 103 is laminated thereon, then joined. The member having rigidity is not limited to the stainless steel plate or the MgO substrate described above, but it may be modified in various ways without departing from the scope of the invention.

Next, as shown at ③ in FIG. 11(B), the dry film resist 103 (corresponding to the dry film resist 103*d* in FIG. 5) of the second layer is laminated on the dry film resist 103 (103*e*) of the first layer, and portions corresponding to the pressure chambers 112, the ink supply channels 114 and the ink common channel 110 are exposed in the masking process (step B30 in FIG. 13).

As shown at ④ in FIG. 11(B), a dry film resist is laminated as an adhesive layer on the back surface of the stainless steel plate 105*b,* and portions corresponding to the conduits 116 and the ink common channel 110 are exposed in the masking process (step B40 in FIG. 13). Incidentally, the adhesive layer is omitted in FIG. 5, for the sake of convenience.

By developing the dry film resists on the both surfaces of the substrate, the (B) layer is formed, as shown at ⑤ in FIG. 11(B) (step B50 in FIG. 13).

A bimorph layered body and a dry film resist are laminated to form (C) layer as shown in FIG. 11(C) (step A30 in FIG. 12).

The (C) layer is configured with three layers of dry film resists. In more detail, step A30 in FIG. 12 is consists of steps C10 through C70 shown in FIG. 14.

As shown at ① in FIG. 11(C), the individual electrodes 109, the contacts 121 and the wiring patterns 123 are patterned on an MgO substrate 122 (step C10 in FIG. 14), then the bimorph layered body 125 configured with the piezoelectric element 108 and the vibrating plate 104 is formed thereon (step C20 in FIG. 14).

Concretely, the piezoelectric element 108 which is a single layer in a direction of the lattice of the MgO substrate 122 is formed into a thin film using a technique that grows the piezoelectric element 108 all over a surface of the MgO substrate 122 by spattering, then the bimorph layered body 125 is formed using a technique that grows a chromium film all over a surface of the piezoelectric element 108 by spattering, plating or the like.

At this time, a resist is coated on all over the piezoelectric elements 108 formed all over the MgO substrate 122, a processing pattern of the piezoelectric element 108 corresponding to each of the pressure chambers 112 is patterned, then unnecessary piezoelectric elements 108 are removed by etching.

Photosensitive liquid polyimide is coated on all over the surface on which the piezoelectric elements 108 on the MgO substrate 122 are formed, its entire surface is exposed from a surface opposite to the surface on which the piezoelectric elements 108 on the MgO substrate 122 are formed, whereby only the polyimide immediately above the MgO substrate 122 is exposed.

After that, the photosensitive liquid polyimide is developed, unexposed polyimide on the piezoelectric elements 108 is removed, so that the polyimide 126 is arranged in only an area in which the piezoelectric elements 108 and the individual elements 109 on the vibrating plate 104 are absent.

Meanwhile, by forming the piezoelectric elements 108 and the vibrating plate 104 on the MgO substrate 122, it is possible to stably form the bimorph layered body 125, and to stably form the dry film resists 103*a* through 103*c* to be described later.

When a piezoelectric element having a layered structure is used as the piezoelectric element 108, each of plural green sheets is formed by mixing ceramic power with a solvent, kneading them into a paste, and forming a thin film of about 50 μm in thickness by using a doctor blade. Ferroelectric material such as Ba, $TiO_3$, $PbTiO_3$, (NaK) $NbO_3$ or the like, which is generally a material of piezoelectric elements, may be used as a material of the piezoelectric elements 108.

In this case, a first internal electrode pattern is printed and formed on one surface of each of three green sheets among the plural (12, for example) green sheets, while a second internal electrode pattern is printed and formed on one surface of each of three green sheets other than the above green sheets. Printing of the first and second internal electrodes is performed by mixing power of metal alloy of silver and palladium with a solvent into a paste, applying the paste, and patterning.

The three green sheets on which the first internal electrode is formed and the three green sheets on which the second internal electrode is formed are alternately laminated, after that, the six green sheets on which no internal electrode is formed are laminated to form the layered structure of the piezoelectric element, and these layered green sheets are sintered. In this case, the green sheets having no internal electrode function as the substrate.

As shown at ② in FIG. 11(C), the dry film resist 103 (corresponding to the dry film resist 103*a* shown in FIG. 5) of the first layer is laminated on the vibrating plate 104, and portions corresponding to the pressure chambers 112 are exposed (step C30 in FIG. 14) in the masking process.

As shown at ③ in FIG. 11(C), the dry film resist 103 (corresponding to the dry film resist 103*b* shown in FIG. 5) of the second layer is laminated on the dry film resist 103*a* of the first layer, and portions corresponding to the pressure chambers 112 and the ink common channel 110 are exposed in the masking process (step C40 in FIG. 14).

As shown at ④ in FIG. 11(C), the dry film resist 103 (corresponding to the dry film resist 103*c* shown in FIG. 5) of the third layer is laminated on the dry film resist 103*b* of the second layer, and portions corresponding to the pressure chambers 112, the ink supply channels 114 and the ink common channel 110 are exposed in the masking process (step C50 in FIG. 14).

As shown at ⑤ in FIG. 11(C), the dry film resists are developed (step C60 in FIG. 14), the layered structure formed by laminating the piezoelectric elements 108 to the dry film resist 103*c* in FIG. 5 is formed on the MgO substrate 122. After that, as shown at ⑥ in FIG. 11(C), the stainless steel plate 105*a* in which portions corresponding to the pressure chambers 112 and the ink common channel 110 have been removed by etching is joined to the dry film resist 103*c* (step C70 in FIG. 14).

In the first embodiment, the number of bonding surfaces among the (A) layer through the (C) layer are two, that is, between the (A) layer and the (B) layer, and the (B) layer and the (C) layer, thus two layers of the stainless steel plates 105*a* and 105*b* are provided.

The (A) layers through the (C) layers are joined and cured (step A40 in FIG. 12).

Since the stainless steel plate 105*a* is provided, the dry film resist 103*c* or the like is prevented from flowing to the dry film resist 103*d* when the (C) layer is joined to the (B) layer.

After that, the dry film resists 103*a* through 103*e* are hardened by applying pressure and heat thereto, and the MgO substrate 122 to the nozzle plate 106 are integrated.

A resist is coated on the MgO surface, patterning and exposure are performed with a pattern in a predetermined shape matched to that of the joint 8, the resist is developed, and unnecessary portions of the MgO substrate 122 are removed by etching, whereby the joint 8 is formed as a remaining part of the MgO substrate (substrate) 122 on the head main body 3.

The contacts 121 and 127 on the head main body 3 formed as above are connected to the FPC 2 by Au bumps to be electrically connected to each other, and the ink tank (the ink supply part) 50 or the ink tank fixing member made by resin molding is adhered using an adhesive agent or the like and hardened, thereby completing the ink jet head 100.

Meanwhile, performing the step of removing the MgO substrate 122 and forming the joint 8 is not limited to after the (A) layer to (C) layer are joined and cured, but the step may be performed after the (C) layer is formed, for example, which may be modified in various ways without departing from the scope of the invention.

Dimensions of the parts of the ink jet head 100 according to the first embodiment are as follows, for example. Here, L denotes length, W denotes width, and t denotes thickness (depth).

individual electrode: L×W×t=1700 (μm)×70 (μm)×0.2 (μm)

wiring pattern: W×t=5 (μm)×0.2 (μm) (Provided that the length differs from element to element)

piezoelectric element: L×W×t=1700 (μm)×70 (μm)×3 (μm)

vibrating plate: t=2 (μm)

pressure chamber: L×W×t=1700 (μm)×100 (μm)×130 (μm)

ink supply channel: L×W×t=125 (μm)×15 (μm)×30 (μm)

conduit: ϕ80 (μm)×60 (μm)

nozzle: ϕ20 (μm)×20 (μm)

link channel: L×W×t=13 (mm)×1 (mm)×0.19 (mm)

MgO substrate: W×t=20 (mm)×0.3 (mm)

MgO etching taper angle: 45 (deg) (Provided that this value differs according to the etching condition. In the first embodiment, 80° C.×(h) is applied using a 50% phosphoric solution, and this value was obtained.)

nozzle pitch: 1/150 (inch)

the number of nozzles: 64

The ink jet head 100 according to the first embodiment of this invention is structured as above. When printing is performed, ink filled in the ink tank 50 is supplied to the ink common channel 110 through the ink supply port 51 and the link channel 81, then supplies to each of the pressure chambers 112 through the ink common channel 110 and the ink supply channels 114.

A drive signal generated by a drive circuit not shown is transmitted to the contacts 121 and 127 via the FPC 2, the ink pressure unit 140 applies pressure to the pressure chamber 112 to discharge the ink from the nozzle 120, thereby to print on the printing paper 200.

According to the ink jet head 100 of the first embodiment of this invention, it is possible to increase the rigidity of the head main body 3 by the joint 8, thus to prevent the head main body 3 from breaking when the ink jet head 100 is fabricated, which leads to improvement of the productivity.

Further, it is possible to readily mount the ink tank 50 or the ink tank fixing member to the head main body 3.

Since the individual electrode 109 and the contact 121 are electrically connected by the wiring pattern 123 which is formed into a thin film, it is unnecessary to air-connecting them by wire bonding or the like, which allows the packaging density of the nozzles to be increased, the size of the ink jet head to be reduced. It is also possible to prevent the head main body 3 from being damaged at the time of the wire boding, and prevent short circuit from occurring in the wires.

The joint 8 is formed into a frame-like shape which enclose the individual electrodes 109 on the surface on which the individual electrodes 109, the contacts 121 and 127, and the wiring patterns 123 on the head main body 3 are formed, and the contacts 121 and 127 are arranged outside the joint 8, whereby the FPCs 2 and the individual electrodes 109 can be electrically connected, readily and certainly.

When the ink tank 50 or the ink tank fixing member is mounted on the head main body 3, a margin to adhere it can be narrowed. This allows reduction in size of the head main body, the ink jet head, and the printing apparatus (the ink jet printer).

When each of the individual electrodes 109 and a corresponding contact 121 are electrically connected, the wiring pattern 123 is made to pass through between the joint 8 and the head main body 3. It is thereby possible to electrically connect each of the individual electrodes 109 to the FPC supplying a signal for controlling the pressure unit 140 without having an effect of the joint 8.

The head main body 3 is formed on the MgO substrate 122, the MgO substrate 122 is partially removed from the head main body 3 to form the ink common channel 110, and the joint 8 is formed as a remaining part of the MgO substrate on the head main body 3. This allows the joint 8 to be made readily and cheaply.

(B) Description of First Modification of First Embodiment

Figure 15:
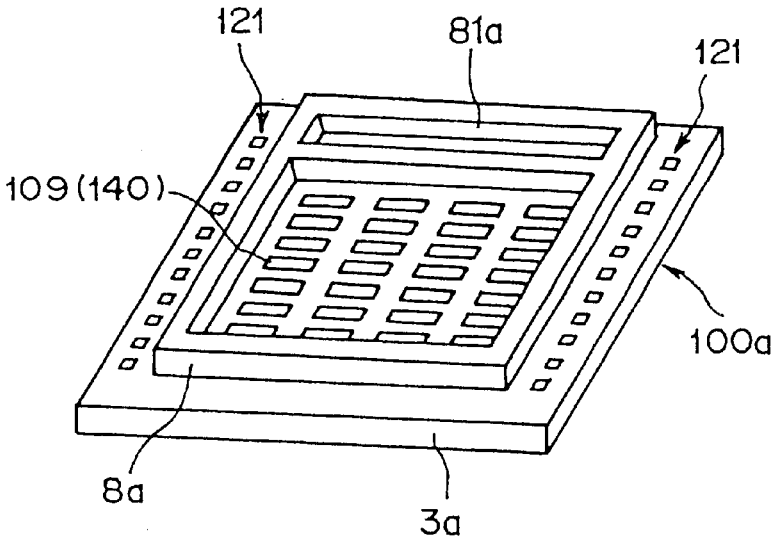
FIG. 15 is a perspective view showing the structure of a head main body of an ink jet head according to a first modification of the first embodiment of this invention.
Figure 16:
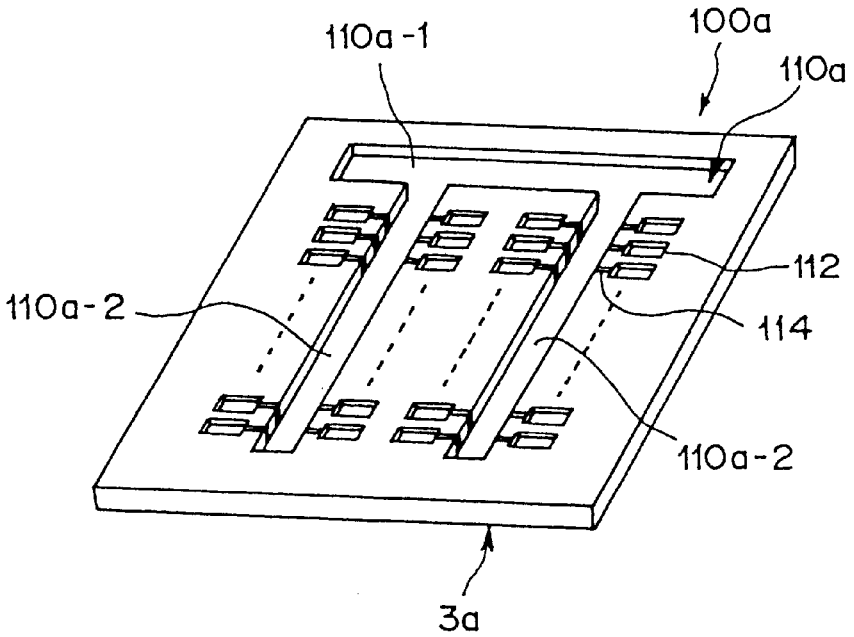
FIG. 16 is a perspective view showing a horizontal cross sectional view of the head main body shown in FIG. 15.

FIGS. 15 and 16 are diagrams for illustrating a first modification of the ink jet head according to the first embodiment. FIG. 15 is a perspective view showing the structure of the head main body of the ink jet head according to the first modification of the first embodiment. FIG. 16 is a perspective view showing a horizontal cross section of the head main body shown in FIG. 15.

Incidentally, like reference characters designates like or corresponding parts in the drawings, detailed descriptions of which are thus omitted.

As shown in FIG. 15, the ink jet head 100*a* according to the first modification has a plurality of nozzles (not shown) discharging ink supplied from an ink tank (an ink supply unit: not shown), along with a head main body 3*a* and a joint 8*a,* like the ink jet head 100 described above according to the first embodiment.

The ink jet head 100*a* has a link channel 81*a* having an opening in a rectangular shape formed over almost the overall width (in the right-to-left direction on the paper in FIG. 15) of the head main body 3*a,* instead of the link channel 81 having a circular opening in the ink jet head 100 according to the first embodiment. The head main body 3*a* is connected to the ink tank through the link channel 81*a*.

The head main body 3*a* comprises an ink common channel 110*a* in its inside, along with a pressure chamber 112, a pressure unit 140 and an ink supply channel 114 for each of the plural nozzles.

The ink common channel 110*a* is configured with, as shown in FIG. 16, a first ink common channel 110*a*-1 formed across almost the overall width of the head main body 3*a,* and two second ink common channels 110*a*-2 which are perpendicular to the first ink common channel 110*a*-1, and in parallel to each other.

Each of the two second ink common channels 110*a*-2 is provided with a plurality of the pressure chambers 112 like branches at positions facing one another across the second ink common channel 110*a*-2. Each of the pressure chambers 112 and the ink common channel 110*a* (the second ink common channel 110*a*-2) are linked and connected through the ink supply channel 114.

In the ink common channel 110*a,* the fluid resistance of ink is adjusted so that rapid internal pressure fluctuations in the pressure chamber 112 are absorbed, like the ink common channel 110 described above. The ink common channel 110*a* supplies a necessary quantity of ink to the pressure chamber 112 when the pressure chamber 112 restores after being applied pressure, contracted, and discharging the ink. Incidentally, supply of the ink, is performed on the basis of adjustment of the fluid resistance of the ink.

In the head main body 3*a,* the pressure chambers 112 are aligned in one direction. The pressure chamber 112 is supplied the ink, accommodates it, and discharges the ink from the nozzle through the conduit 116 when the internal pressure builds up.

The joint 8*a* is formed to project from a surface (on the side where the individual electrodes 109 of the head main body 3 are formed) opposite to a surface on which the nozzles of the head main body 3 are formed. The joint 8*a* is formed to enclose the individual electrodes 109 on the surface on which the individual electrodes 109 of the head main body 3*a* are formed.

Namely, the joint 8*a* is formed so as to enclose the individual electrodes 109 on the surface on which the individual electrodes 109, the contacts 121 and the wiring patterns (not shown) are formed.

Apart of the joint 8*a* is formed so as to enclose the link channel 81*a*.

An ink tank (an ink supply unit) or an ink tank fixing member is mounted on the joint 8*a* using an adhesive agent or the like, whereby the ink tank is mounted on the head main body 3*a*. Even when the ink tank is mounted to the joint 8*a,* ink from the ink tank to be supplied to the link channel 81*a* is prevented from flowing to the individual electrodes 109.

The joint 8*a* has a cross sectional shape the width of which becomes narrower as the height increases, like the joint 8*a* in the ink jet head 100 according to the first embodiment. Whereby, the adhesive agent forced out from the bonding surface is held on its slopes, so that the adhesive agent is prevented from reaching the head main body 3*a*.

The joint 8*a* is formed as a remaining part of the substrate on the head main body 3*a* by partially removing the substrate made of magnesium oxide (MgO) from the head main body 3*a* in the photoetching process, like the above joint 8.

A plurality of contacts 121 are formed on a surface on which the individual electrodes 109 of the head main body 3*a* are formed, in the vicinity of the outer periphery of the head main body 3, concretely, outside the joint 8*a,* like the head main body 3 of the ink jet head 100 according to the first embodiment.

The ink jet head 100*a* according to the first modification of the first embodiment of this invention is structured as above. Accordingly, even if an adhesive agent is forced out from between the joint 8*a* and the ink tank when the ink tank or the ink tank fixing member is mounted on the joint 8*a* using an adhesive agent or the like, the adhesive agent does not reach the pressure unit 140 of the individual electrode 109, and the like. Thus, the pressure applying operation of the pressure unit 140 is not disturbed, and the quality of printing of the ink jet head can be improved.

When ink is supplied from the ink supply port of the ink tank to the head main body 3*a* through the link channel 81*a,* the ink passes through the first ink common channel 110*a*-1 and the second ink common channels 110*a*-2, and supplied to each of the pressure chambers 112 through each of the ink supply channels 114.

A drive signal is supplied from a driving circuit or the like not shown to each of the individual electrodes 109 via the FPC (not shown) to apply pressure to the pressure chamber 112 by the pressure unit 140, whereby the ink is discharged from the nozzle.

The first modification of the ink jet head according to the first embodiment of this invention can provide the similar functions and effects to those provided by the above first embodiment. Further, since ink from the ink tank is supplied to the head main body 3*a* through the link channel 81*a* having a rectangular cross section formed across almost the overall width of the head main body 3*a* and the ink common channel 110*a*-1, it is possible to steadily supply the ink to even the pressure chamber 112 disposed at the end of the ink common channel 110, that is, in the vicinity of the opposite side to the side where the ink common channel 110*a*-2 is connected to the ink common channel 110*a*-1.

Namely, it is possible to equalize the ink pressure in each of the pressure units 112, so that the quantity of ink discharged from each of the nozzles, which leads to improvement of the printing quality.

(C) Description of Second Modification of First Embodiment

Figure 17:
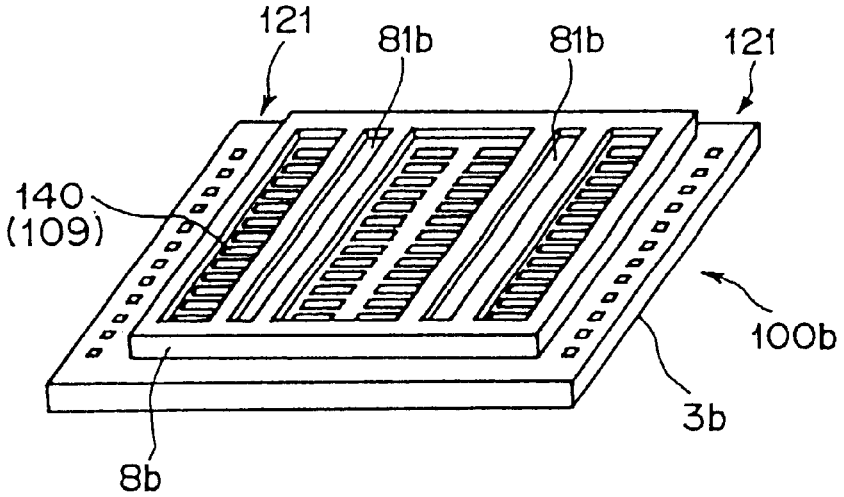
FIG. 17 is a perspective view showing the structure of a head main body of an ink jet head according to a second modification of the first embodiment of this invention.
Figure 18:
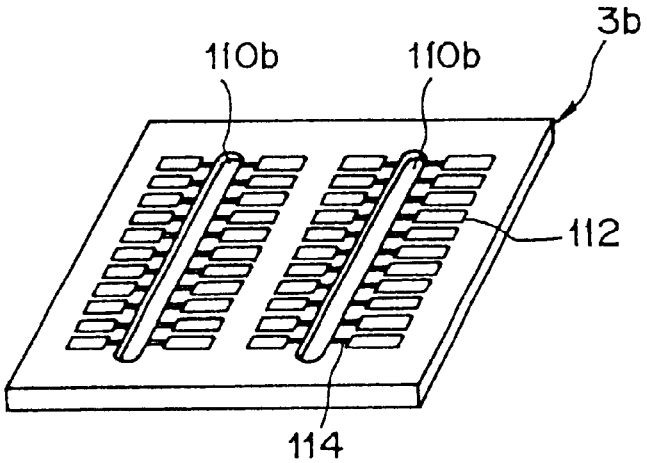
FIG. 18 is a perspective view showing a horizontal cross sectional view of the head main body shown in FIG. 17.

FIGS. 17 and 18 are diagrams for illustrating a second modification of the ink jet head of the first embodiment. FIG. 17 is a perspective view showing the structure of a head main body of the ink jet head according to the second modification of the first embodiment of this invention. FIG. 18 is a perspective view showing a horizontal cross section of the head main body shown in FIG. 17.

Incidentally, like reference characters designate like or corresponding parts in the drawings, detailed descriptions of which are thus omitted.

As shown in FIG. 17, the ink jet head 100*b* according to the second modification has a plurality of nozzles (not shown) discharging ink supplied from an ink tank (an ink supply unit: not shown), like the above ink jet head 100 according to the first embodiment. The ink jet head 100*b* also has the head main body 3*b* and a joint 8*b*.

In the ink jet head 10*b*, instead of the link channel 81 having a circular opening in the ink jet head 100 according to the first embodiment, two link channels 81*b* each having a rectangular opening are formed in parallel to each other across almost the overall length in the vertical direction of the head main body 3*b* (in a direction in parallel to an edge surface on which the contacts 121 are formed in FIG. 17). The head main body 3*b* is connected to the ink tank through these link channels 81*b*.

The head main, body 3*b* has a pressure chamber 112, a pressure unit 140 and an ink supply channel 114 for each of the plural nozzles.

In the head main body 3*b*, the two ink common channels 10*b* are formed in parallel to each other across almost the overall length of the head main body 3*b* in the vertical direction of the same (in a direction in parallel to an edge surface on which contacts 121 are formed in FIG. 17), as shown in FIG. 18.

To each of these two ink common channels 110*b* disposed are a plurality of the pressure chambers 112 like branches at positions facing one another across the ink common channel 10*b*. Each of the pressure chambers 112 and the ink common channel 110*b* are linked and connected through the ink supply channel 114.

In the ink common channels 110*b*, the fluid resistance of the ink is adjusted so that rapid internal pressure fluctuations in the pressure chamber 112 are absorbed, like the above ink jet head 100 according to the first embodiment. When the pressure chamber 112 restores after applied pressure, contracted and discharging the ink, the ink common channel 110*b* supplies a necessary quantity of ink to the pressure chamber 112 through the ink supply channel 114. Incidentally, supply of the ink is performed on the basis of adjustment of the fluid resistance of the ink.

Each of the pressure chambers 112 is supplied the ink and accommodates it, and discharges the ink from the nozzle 120 through the conduit 116 when the internal pressure builds up. The pressure chambers 112 are aligned in one direction in the head main body 3*b* of the ink jet head 10*b*. As shown in FIG. 17, the pressure chambers 112 are arranged in parallel to one another, perpendicular to the common channels 110*b* (the link channels 81*b*).

The joint 8*b* is formed to project from a surface (on the side where the individual electrodes 109 of the head main body 3*b* are formed) opposite to a surface on which the nozzles of the head main body 3*b* are formed, and to enclose the individual electrodes 109 on the surface on which the individual electrodes 109 of the head main body 3*a* are formed.

Namely, the joint 8*b* is formed so as to enclose the individual electrodes 109 on the surface on which the individual electrodes 109, the contacts 121 and the wiring patterns (not shown) are formed.

A part of the joint 8*b* is formed to enclose each of the link channels 81*b*.

An ink tank (an ink supply unit) or an ink tank fixing member is mounted on the joint 8*b* using an adhesive agent or the like, whereby the ink tank is mounted on the head main body 3*b*. Even when the ink tank is mounted on the joint 8*b*, ink supplied from the ink tank to each of the link channels 81*b* is prevented from flowing to the individual electrodes 109.

The joint 8*b* has a cross-sectional shape the width of which becomes narrower as the height increases, like the joint 8 of the ink jet head 100 according to the first embodiment. Whereby, the adhesive agent forced out from the bonding surface is held on its slopes, and prevented from reaching the head main body 3*b*.

Like the joint 8 described above, the joint 8*b* is formed as a remaining part of a substrate on the head main body 3*b* by partially removing the substrate made of magnesium oxide (MgO) from the head main body 3*b* in the photoetching process.

A plurality of contacts 121 are formed on a surface on which the individual electrodes 109 of the head main body 3*a* are formed, in the vicinity of the outer periphery of the head main body 3, concretely, outside the joint 8*b*, like the head main body 3 of the ink jet head 100 according to the first embodiment.

The ink jet head according to the second modification of the first embodiment of this invention is structured as above. When ink is supplied from an ink supply port of the ink tank through the link channels 81*b* after the ink tank or the ink tank fixing member is mounted on the joint 8*b* using an adhesive agent or the like, the ink passes through the ink common channels 110*b*, then is supplied to each of the pressure chambers 112 through the ink supply channel 114.

A drive signal is supplied from a drive circuit or the like not shown to each of the individual electrodes 109 through an FPC (not shown), whereby the pressure unit 140 applies pressure to the pressure chambers 112 to discharge the ink from the nozzle.

The second modification of the ink jet head according to the first embodiment of this invention can provide the similar functions and effects to those provided by the above first embodiment. Additionally, since a distance for which the ink is supplied from the ink tank to each of the pressure chambers 112 is equal among the pressure chambers 112, it is possible to stabilize the ink supply to each of the pressure chambers 112. Thus, it is possible to equalize a quantity of ink discharged from each of the nozzles, which leads to improvement of the printing quality.

(D) Description of Third Modification of First Embodiment

Figure 19A:
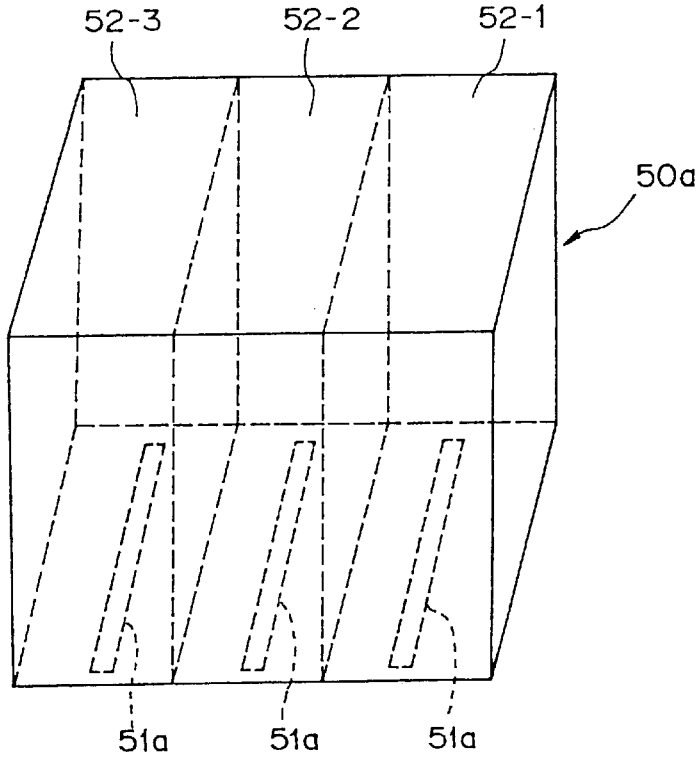
FIG. 19(*a*) is a perspective view showing an ink tank in order to illustrate the shape of the ink tank in an ink jet head according to a third modification of the first embodiment of this invention.
Figure 19B:
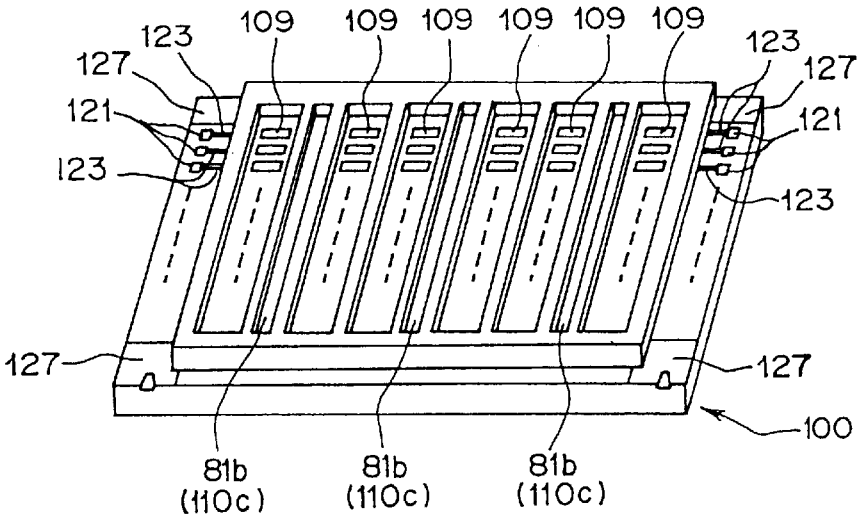

FIGS. 19(*a*) and 19(*b*) are diagrams for illustrating a third modification of an ink jet head of the first embodiment. FIG. 19(*a*) is a perspective view showing ink tanks in order to illustrate a shape of each ink tank in the ink jet head according to the third modification of the first embodiment of this invention. FIG. 19(*b*) is a perspective view showing the structure of a head main body of the ink jet head according to the third modification of the first embodiment of this invention.

Incidentally, like reference characters designate like or corresponding parts in the drawings, detailed descriptions of which are thus omitted.

As shown in FIG. 19(*b*), the ink jet head 100*c* according to the third modification performs multi-color printing using plural colors of ink (three colors, yellow, magenta and cyan, in this modification) The ink jet head 100*c* has nozzles (not shown) for discharging the respective colors of ink, along with a head main body 3*c* and a joint 8*c*.

The head main body 3*c* has a pressure chamber 112, a pressure unit 140 and an ink supply channel 114 for each of the plural nozzles.

The ink jet head 100*c* is mounted thereon an ink tank (an ink supply unit) 50*a* holding three colors of ink, namely, yellow, magenta and cyan, by means of the joint 8*c*.

As shown in FIG. 19(*a*), the ink tank 50*a* is formed to have ink chambers 52-1 through 52-3 in number (three in the third modification) corresponding to the colors of ink to be used. The ink chambers 52-1 through 52-3 are divided by bulkheads. In each of the ink chambers 52-1 through 52-3 filled is a different kind (color) of ink. In the third modification, yellow ink is filled in the ink chamber 52-1, cyan ink in the ink chamber 52-2, and magenta ink in the ink chamber 52-3, for example.

Each of the ink chambers 52-1 through 52-3 has an ink supply port 51*a* for supplying the ink. These ink supply ports 51*a* are arranged in parallel. Namely, the ink tank 51*a* has the three ink supply ports 51*a* arranged in parallel.

In the head main body 3*c* of the ink jet head 100*c*, three link channels 81*b*, similar to those of the ink jet head 100*b* according to the second modification, are formed across almost the overall length of the head main body 3*c* in the vertical direction of the same (in a direction in parallel to an edge surface on which the contacts 121 are formed in FIG. 19(*b*)), as shown in FIG. 19(*b*). Further, three ink common channels 110*c* each having almost the identical cross-sectional shape to that of the link channel 81*b* are formed in the head main body 3*c*.

To each of the three ink common channels 110*c* provided are a plurality of pressure chambers 112 like branches at positions facing one another across the ink common channel 110*c*. Each of the pressure chambers 112 and the ink common channel 110*c* are linked and connected through the ink supply channel 114.

Namely, the head main body 3*c* is connected to the ink tank 50*a* as shown in FIG. 19(*b*) through the three link channels 81*b*.

In the ink common channels 110*c*, like the ink common channel 110 in the ink jet head 100 according to the above first embodiment, the fluid resistance of ink is adjusted so as to absorb rapid internal pressure fluctuations in the pressure chambers 112. The ink common channels 110*c* supply a necessary quantity of ink when the pressure chamber restores after applied pressure, contracted and discharging the ink. Incidentally, supply of ink is performed on the basis of adjustment of the fluid resistance of the ink.

Each of the pressure chambers 112 is supplied ink and accommodates it, and discharges the ink from the nozzle 120 through the conduit 116 when the internal pressure builds up. The pressure chambers 112 are aligned in one direction in the head main body 3*c* of the ink jet head 100*c*. As shown in FIG. 19(*b*), the pressure chambers 112 are arranged in parallel, perpendicular to the ink common channels 110*c*.

The joint 8*c* is formed to project from a surface (on the side where the individual electrodes 109 of the head main body 3*c* are formed) opposite to a surface on which the nozzles of the head main body 3*c* are formed, as shown in FIG. 19(*b*). The joint 8*c* is formed to enclose the individual electrodes 109 on the surface on which the individual electrodes of the head main body 3*c* are formed.

Namely, the joint 8*c* is formed so as to enclose the individual electrodes 109 on a surface on which the individual electrodes 109, the contacts 121 and the wiring patterns 123 are formed.

A part of the joint 8*c* is formed to enclose each of the link channels 81*c*.

The ink tank (the ink supply unit) 50*a* or an ink tank fixing member is mounted on the joint 8*c* using an adhesive agent or the like, whereby the ink tank 50*a* is mounted on the head main body 3*c*. Even when the ink tank 50*a* is mounted on the joint 8*c*, the ink from the ink tank 50*a* to be supplied to each of the link channels 81*b* is prevented from flowing to the individual electrodes 109.

Like the joint 8 in the ink jet head 100 according to the first embodiment, the joint 8*c* has a shape the width of which becomes narrower as the height increases, whereby the adhesive agent forced out from the bonding surface is held on its slopes, so that the adhesive agent is prevented from reaching the head main body 3*c*.

Like the joint 8 or the like described above, the joint 8*c* is formed as a remaining part of a substrate on the head main body 3*c* by partially removing the substrate made of magnesium oxide (MgO) from the head main body 3*c* in the photoetching process.

A plurality of contacts 121 are formed on a surface on which the individual electrodes 109 of the head main body 3*c* are formed, in the vicinity of the outer periphery of the head main body 3, concretely, outside the joint 8*c*, like the head main body 3 of the ink jet head 100 according to the first embodiment.

The ink jet head according to the third modification of the first embodiment of this invention is structured as above. When each color of ink is supplied from the ink supply port 51*a* of the ink tank 50*a* to the head main body 3*c* through the link channel 81*b* after the ink tank 50*a* is mounted on the joint 8*c* using an adhesive agent or the like, the ink passes through the ink common channel 110*c*, and is supplied to each of the pressure chambers 112 through the ink supply channel 114.

A drive signal is supplied to each of the individual electrodes 109 through an FPC (not shown) by a drive circuit or the like not shown, whereby the pressure unit 140 applies pressure to the pressure chamber 112 to discharge the ink from the nozzle.

The third modification of the ink jet head according to the first embodiment of this invention provides the similar functions and effects to those provided by the second modification. Additionally, even when printing is performed with plural colors of ink, it is possible to equalize a quantity of ink discharged from each of the nozzles, which leads to improvement of the printing quality.

The neighboring link channels 81*c* are divided by the joint 8*c*. It is therefore possible to increase the positioning accuracy of each of the nozzles 120 in the multi-nozzle ink jet head (the ink jet head 100*c*) capable of multi-color printing, and form the nozzles 120 in high density. This allows the size of not only the ink jet head but also the printing apparatus (ink jet printer) to be reduced.

(E) Description of Fourth Modification of First Embodiment

Figure 20:
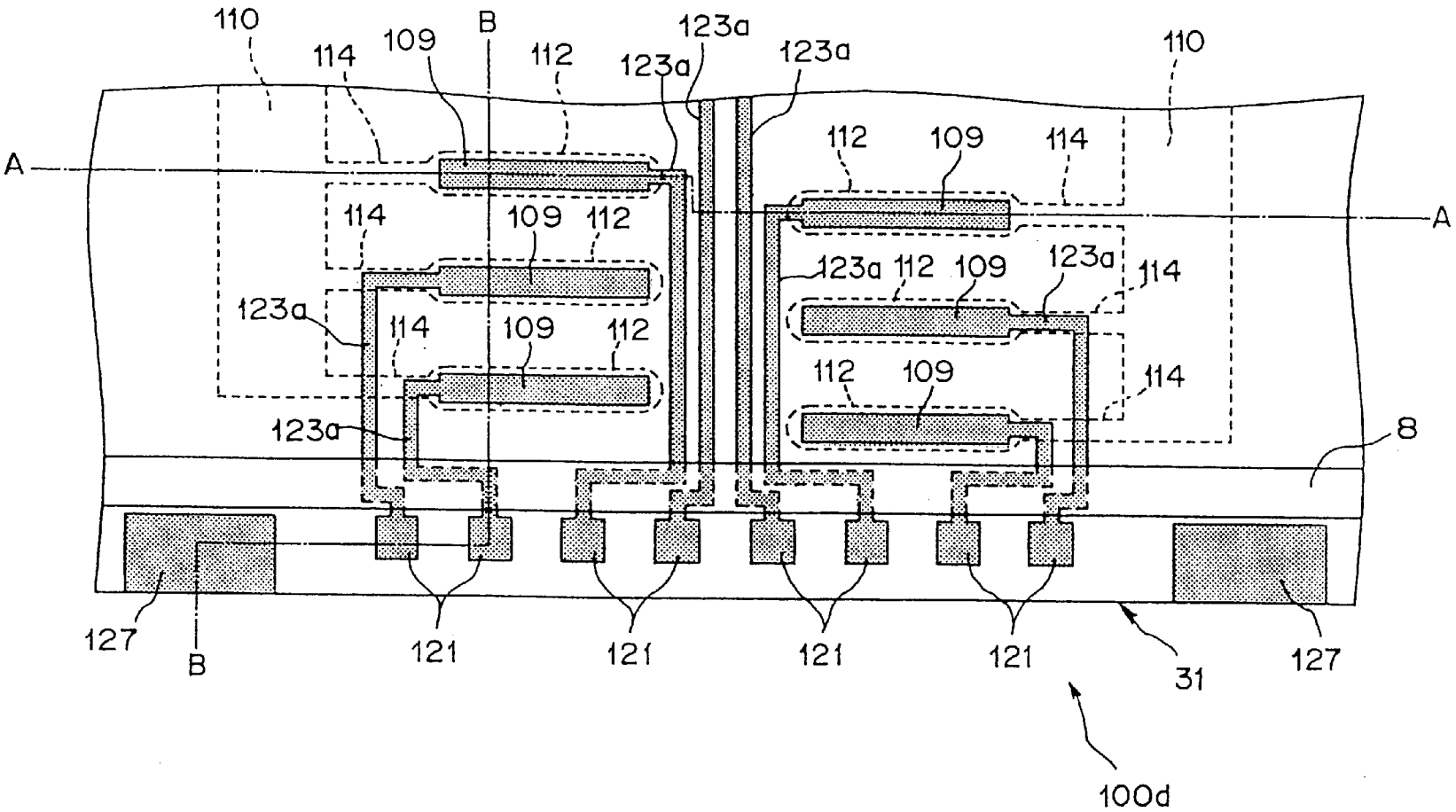
FIG. 20 is an enlarged plan view of essential parts of wiring patterns in an ink jet head according to a fourth modification of the first embodiment of this invention.
Figure 21:
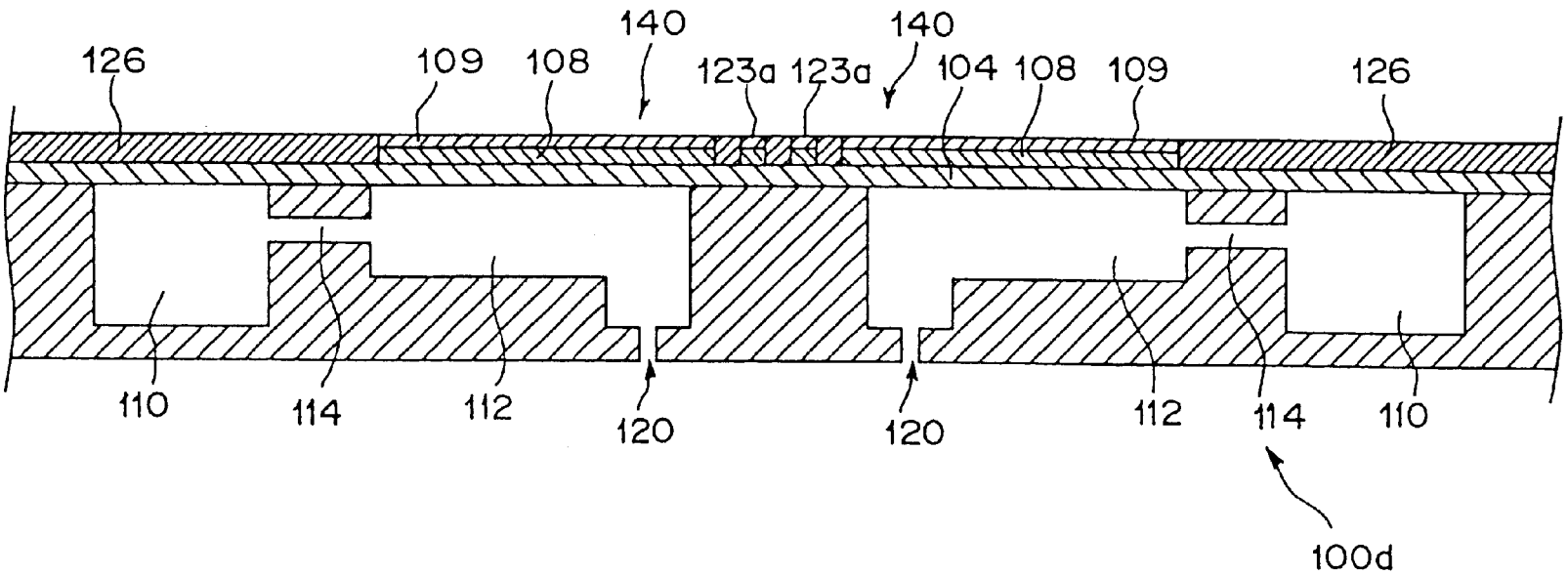
FIG. 21 is a cross sectional view taken along line A—A in FIG. 20.
Figure 22:
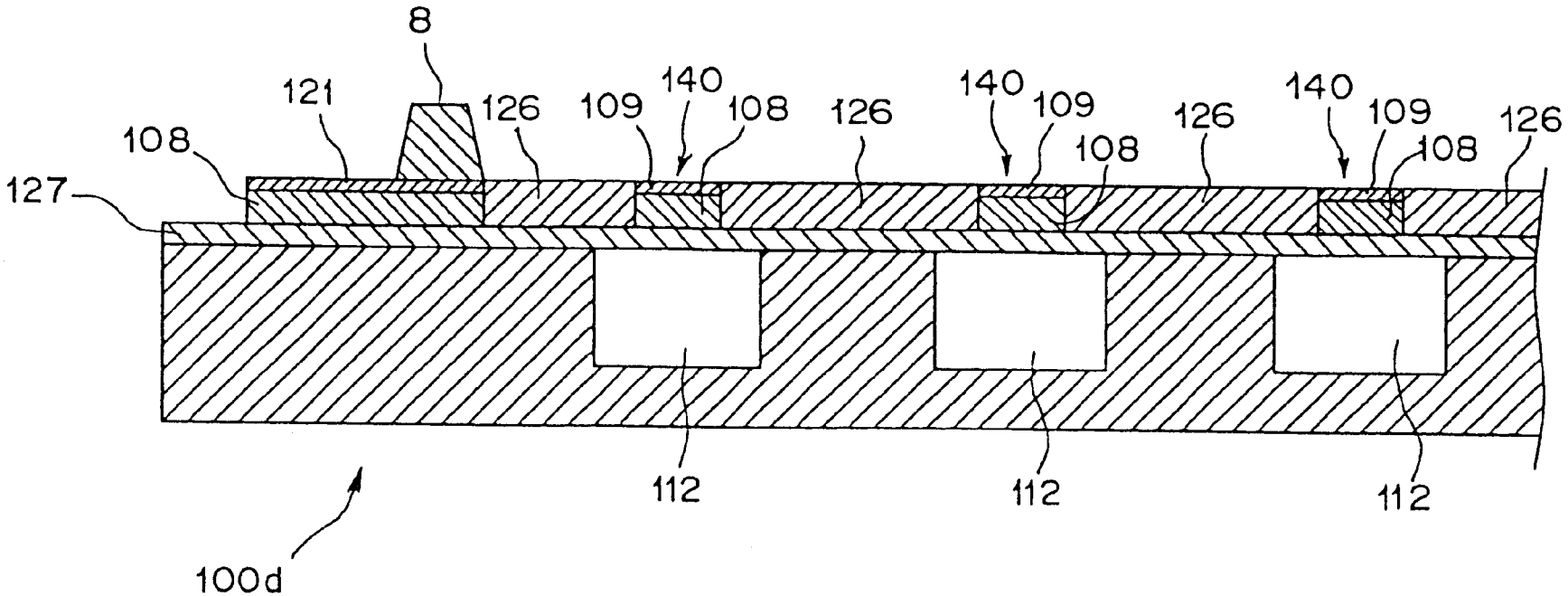
FIG. 22 is a cross sectional view taken along line B—B in FIG. 20.

FIGS. 20 through 22 are diagrams for illustrating the structure of wiring patterns in the ink jet head according to a fourth modification of the first embodiment of this invention. FIG. 20 is an enlarged plan view of essential parts of the wiring patterns in the ink jet head according to the fourth modification of the first embodiment of this invention. FIG. 21 is a cross-sectional view taken along line A—A in FIG. 20. FIG. 22 is a cross-sectional view taken along line B—B in FIG. 20.

Incidentally, like reference characters designate like or corresponding parts in the drawings, detailed descriptions of which are thus omitted.

The ink jet head 100*d* according to the fourth modification of the first embodiment of this invention has wiring patterns 123*a,* instead of the wiring pattern 123 in the ink jet head 100 according to the first embodiment. Hereinafter, description will be made of them with reference to FIGS. 20 through 22.

As shown in FIGS. 20 through 22, the ink jet head 100*d* according to the fourth modification has a plurality of nozzles 102 which discharge ink supplied from an ink tank (an ink supply unit) not shown, along with a head main body 31 and a joint 8, like the above ink jet head 100 according to the first embodiment.

Like the above ink jet head 100, the ink jet head 100*d* according to the fourth modification is formed by laying a plurality of layers of dry film resists 103*a* through 103*e,* stainless steel plates 105*a* and 105*b,* etc. In FIGS. 21 and 22, the layered structure is omitted, for the sake of convenience.

As shown in FIGS. 20 through 22, the wiring patterns 123*a* are formed along with individual electrodes 109 and contacts 121 on the head main body 31 by patterning. The wiring patterns 123*a* are integrally formed into a thin film of the same material on the same surface as the individual electrodes 109 and the contacts 121.

The wiring patterns 123*a* are, as shown in FIG. 20, disposed so as to pass between the individual electrodes 109, almost in parallel to a longitudinal direction (in the right-to-left direction in FIG. 20) of the individual electrodes 109. Additionally, each of the wiring patterns 123*a* is, as shown in FIG. 22, disposed so as to pass under the joint 8, that is, between the head main body 31 and the joint 8.

In the head main body 31, a vibrating plate 104 is exposed on a surface on which the individual electrodes 109, etc. in the head main body 3 are formed, outside the joint 8, namely, in the vicinity of a corner of the head main body 31, thereby forming a contact 127, as in the ink jet head 100 shown in FIG. 11.

An FPC (external connection wiring member: not shown in FIGS. 20 through 22) is electrically connected to the contacts 121 and 127 using a technique of TAB or the like.

Like the ink jet head 100 according to the first embodiment, the ink jet head 100*d* according to the fourth modification is formed of dry film resists by patterning. The wiring patterns 123*a* are formed along with the individual electrodes 109 and the contacts 121 on the head main body 31 by patterning, as well, formed into a thin film of the same material on the same surface as the individual electrodes 109 and the contacts 121.

In the above structure, the contacts 121 and 127 are electrically connected to the FPC using a technique of TAB or the like, after that, a drive signal is supplied to each of the individual electrodes 109 from a drive circuit or the like (not shown) via the FPC, whereby the pressure unit 140 applies pressure to the pressure chamber 112 to discharge ink from the nozzle 120.

As above, the ink jet head according to the fourth modification of the first embodiment of this invention can electrically connect each of the individual electrodes 109 to the FPC which supplies a signal for controlling the pressure unit without having an effect of the joint 8 when each of the individual electrodes 109 and the contact 121 are electrically connected, which can thus provide the similar functions and effects to those provided by the first embodiment.

(F) Description of Fifth Modification of First Embodiment

Figure 23:
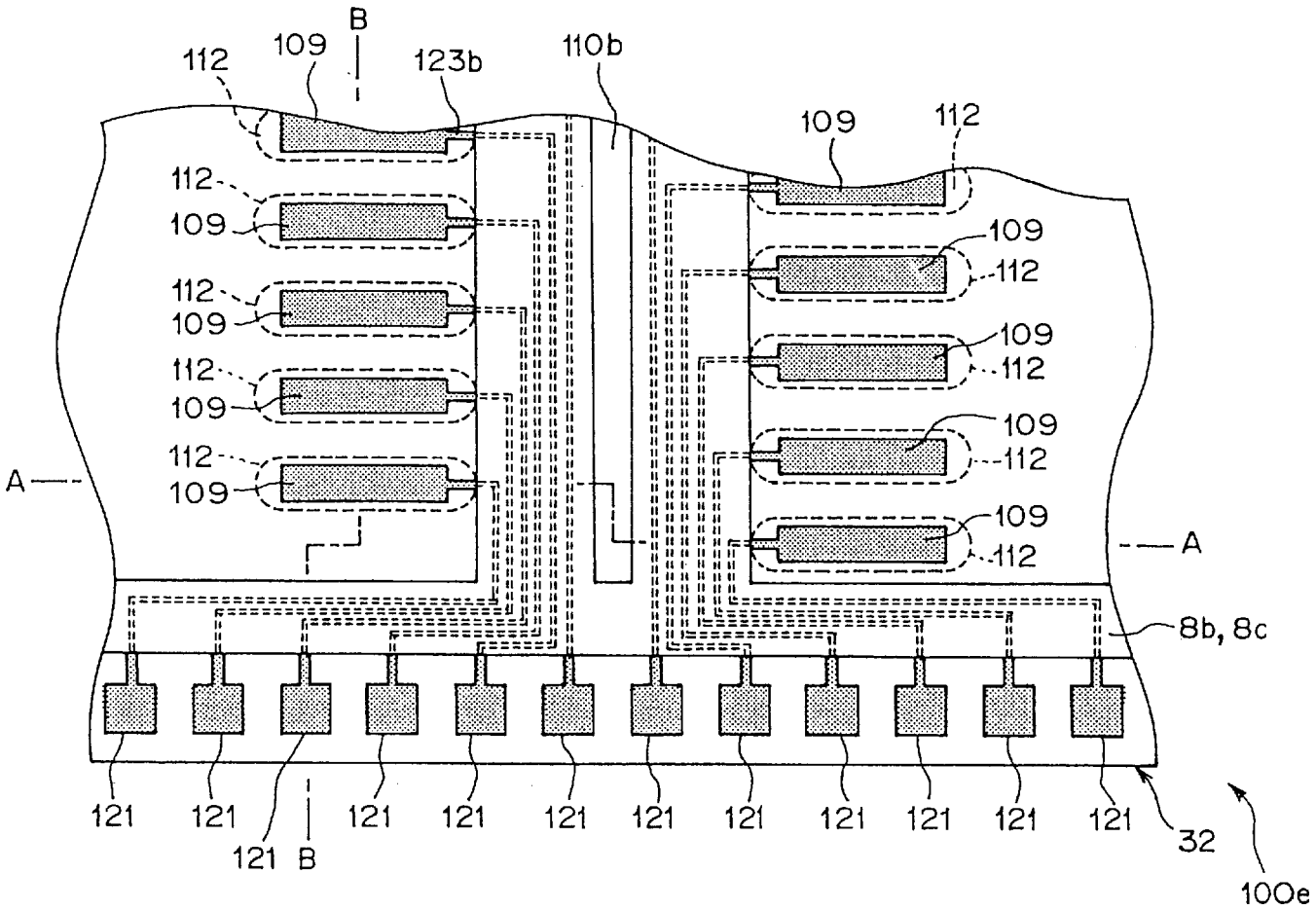
FIG. 23 is an enlarged plan view of essential parts of wiring patterns in an ink jet head according to a fifth modification of the first embodiment of this invention.
Figure 24:
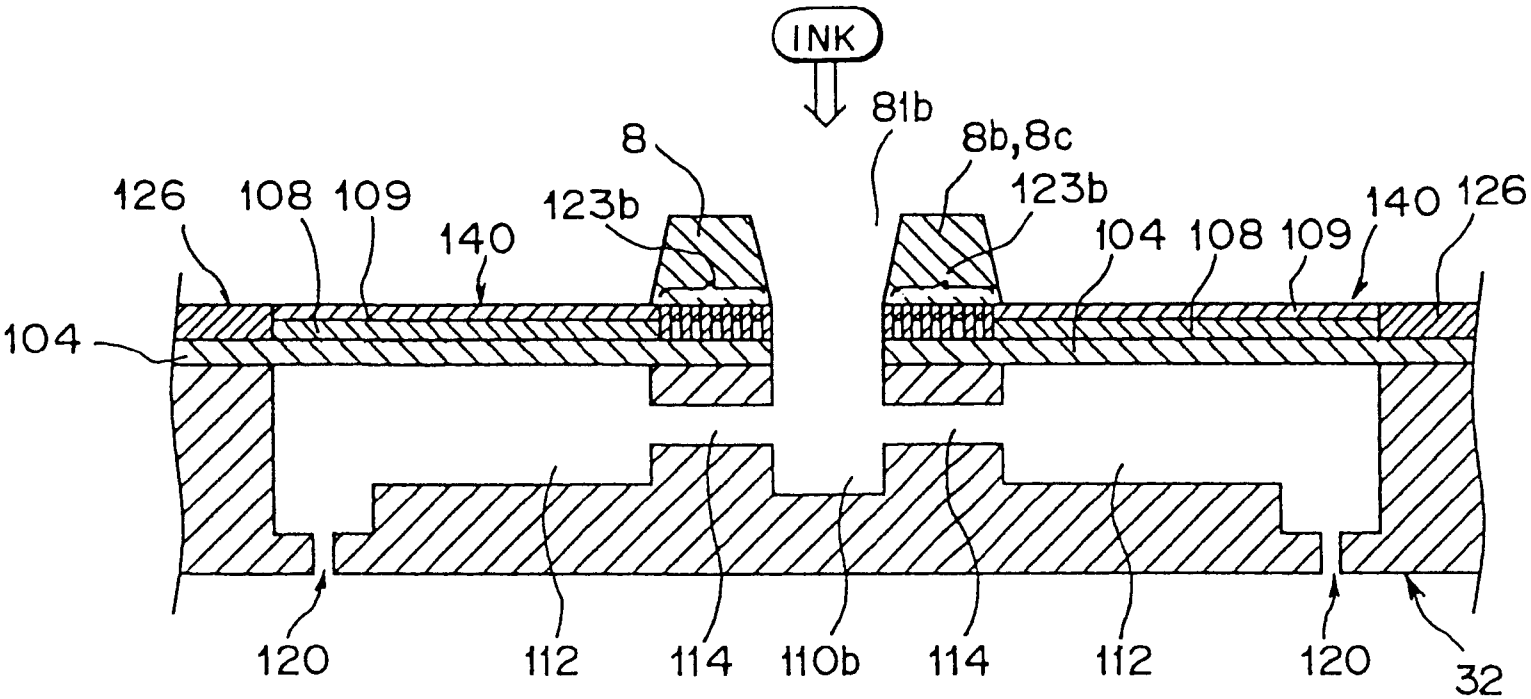
FIG. 24 is a cross sectional view taken along line A—A in FIG. 23.
Figure 25:
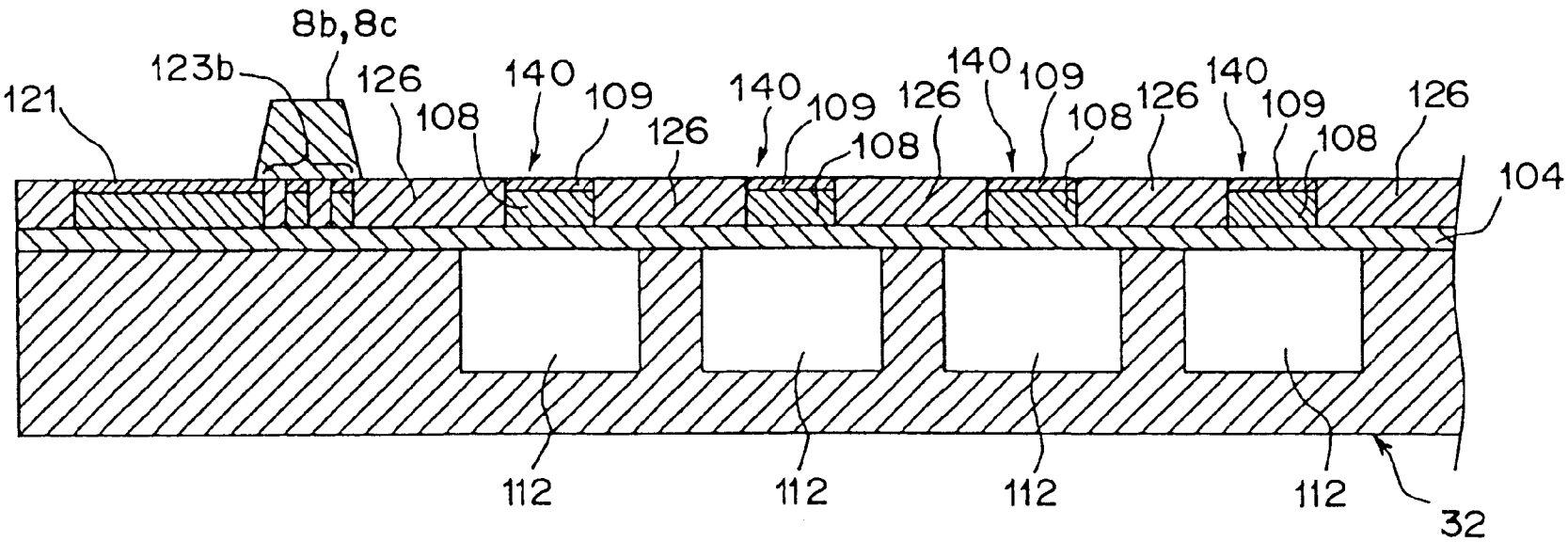
FIG. 25 is a cross sectional view taken along line B—B in FIG. 23.

FIGS. 23 through 25 are diagrams for illustrating the structures of wiring patterns in an ink jet head 100*e* according to a fifth modification of the first embodiment of this invention. FIG. 23 is an enlarged plan view showing essential parts of the wiring patterns in the ink jet head according to the fifth modification of the first embodiment of this invention. FIG. 24 is a cross-sectional view taken along line A—A in FIG. 23. FIG. 25 is a cross-sectional view taken along line B—B in FIG. 23.

Incidentally, like reference characters designate like or corresponding parts in the drawings, detailed description of which are thus omitted.

The ink jet head 100*e* according to the fifth modification of the first embodiment of this invention has wiring patterns 123*b* instead of the wiring patterns 123 in the ink jet head 100*b* shown in FIGS. 17 and 18, or the ink jet head 100*c* shown in FIG. 19. The structures of the wiring patterns 123*b* will be now described with reference to FIGS. 23 through 25.

As shown in FIGS. 23 through 25, the ink jet head 100*e* according to the fifth modification has a plurality of nozzles 120 which discharge ink supplied from an ink tank (an ink supply unit; not shown in FIGS. 23 through 25), along with a head main body 32 and a joint 8*b* (8*c*), like the ink jet heads 100*b* and 100*c* described above.

Like the above-described ink jet head 100, the ink jet head 100*e* according to the fifth modification is formed by laying a plurality of layers of dry film resists 103*a* through 103*e,* stainless steel plates 105*a* and 105*b,* etc. The layered structure is omitted in FIGS. 24 and 25, for the sake of convenience.

Like the ink jet heads 100*b* and 100*c* described above, the ink jet head 100*e* according to the fifth modification is formed of dry film resists using a patterning technique. The wiring patterns 123*b* are formed along with the individual electrodes 109 and contacts 121 on the head main body 32 by patterning, formed on the same surface and of the same material as the individual electrodes 109 and the contacts 121.

As shown in FIGS. 23 and 24, the wiring patterns 123*b* are laid under the joint 8*b* (8*c*), along the joint 8*b* (8*c*) between the head main body 32 and the joint 8*b* (8*c*). Each of the wiring patterns 123*b* departs from the joint 8*b* (8*c*) at a point in proximity to the contact 121, and is connected to the contact 121.

In the head main body 32, as shown in FIGS. 23 and 24, a vibrating plate 104 is exposed on a surface on which the individual electrodes 109, etc. of the head main body 32 are formed, outside the joint 8*b* (8*c*), that is, in the vicinity of a corner of the head main body 32, thereby forming a contact 127.

An FPC (an external connection wiring member; not shown in FIGS. 23 through 25) is electrically connected to the contacts 121 and 127 using a technique of TAB or the like.

In the above structure, after the FPC is electrically connected to the contacts 121 and 127 using a technique of TAB or the like, a drive signal is supplied from a drive circuit or the like not shown to each of the individual electrodes 109 via the FPC, whereby the pressure unit 140 applies pressure to the pressure chamber 112 to discharge ink from the nozzle.

The ink jet head 100*e* according to the fifth modification of the first embodiment of this invention can electrically connect the FPC which supplies a signal for controlling the pressure unit 140 to each of the individual electrodes 109 without having an effect of the joint 8*b* (8*c*) when each of the individual electrodes 109 and the contact 121 are electrically connected. The ink jet head according to the fifth modification can provide the similar functions and effects to those provided by the above ink jet head according to the fourth modification of the first embodiment. Since the wiring patterns 123*b* are laid between the joint 8*b* (8*c*) and the head main body 32, the wiring patterns 123*b* are not exposed to the outside, so that the wiring patterns 123*b* can be protected, thus cutoff or the like of the wiring patterns 123*b* can be prevented, for example.

(G) Description of Second Embodiment

Figure 26:
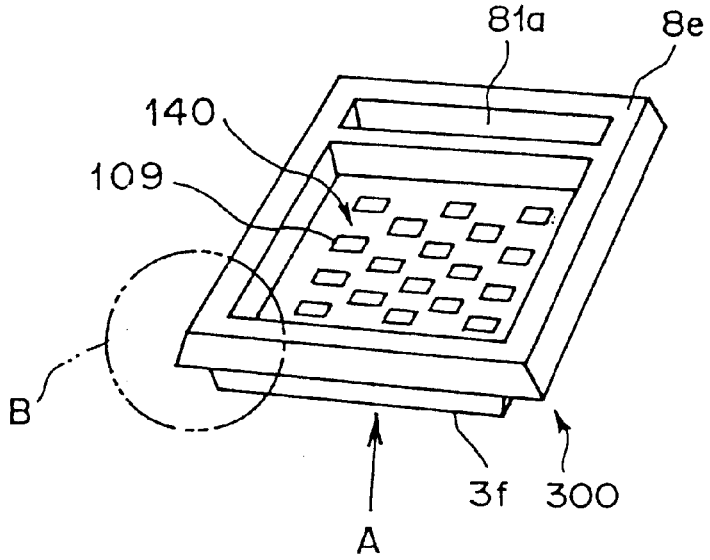
FIG. 26 is a perspective view showing the structure of a head main body of an ink jet head according to a second embodiment of this invention.
Figure 27:
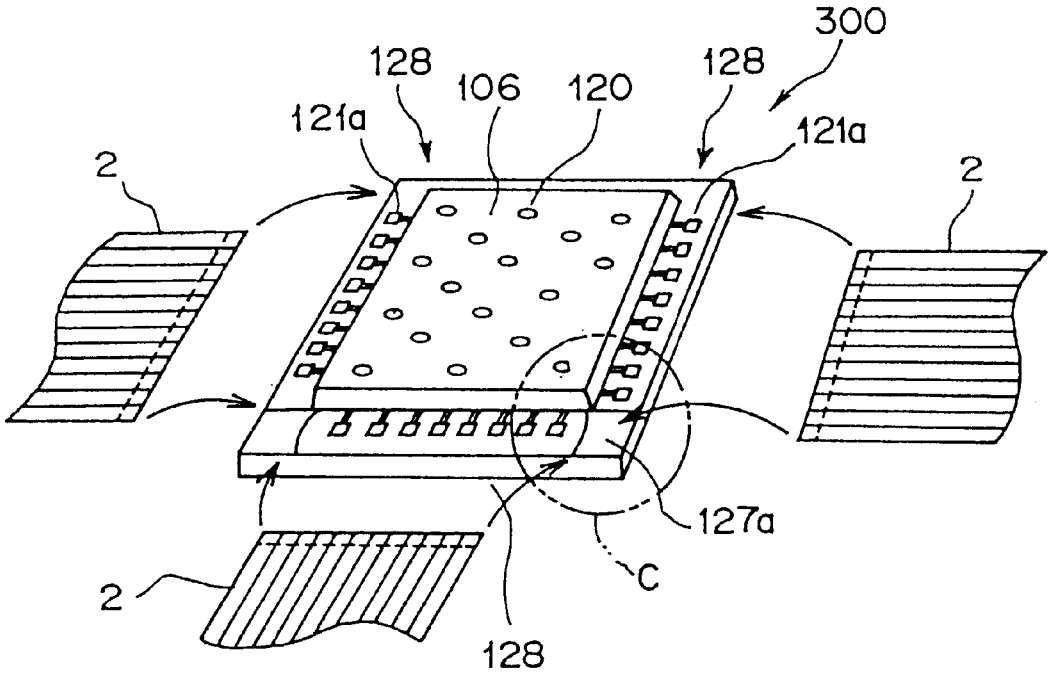
FIG. 27 is a view in the direction of the arrow A in FIG. 26.
Figure 28:
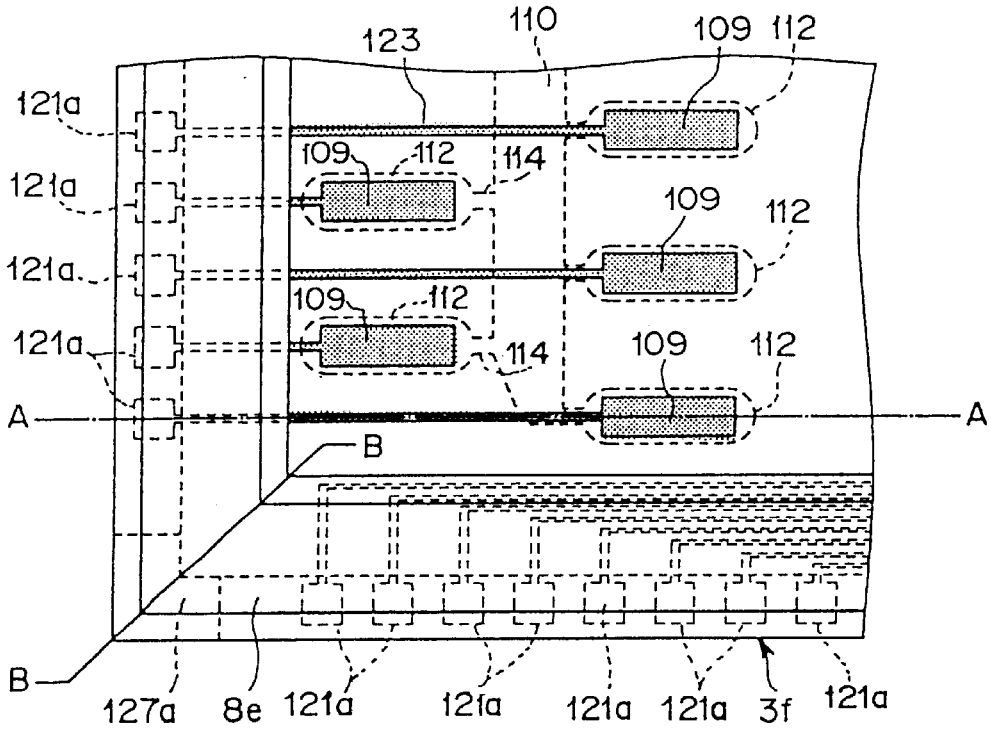
FIG. 28 is an enlarged plan view of B portion in FIG. 26.
Figure 29:
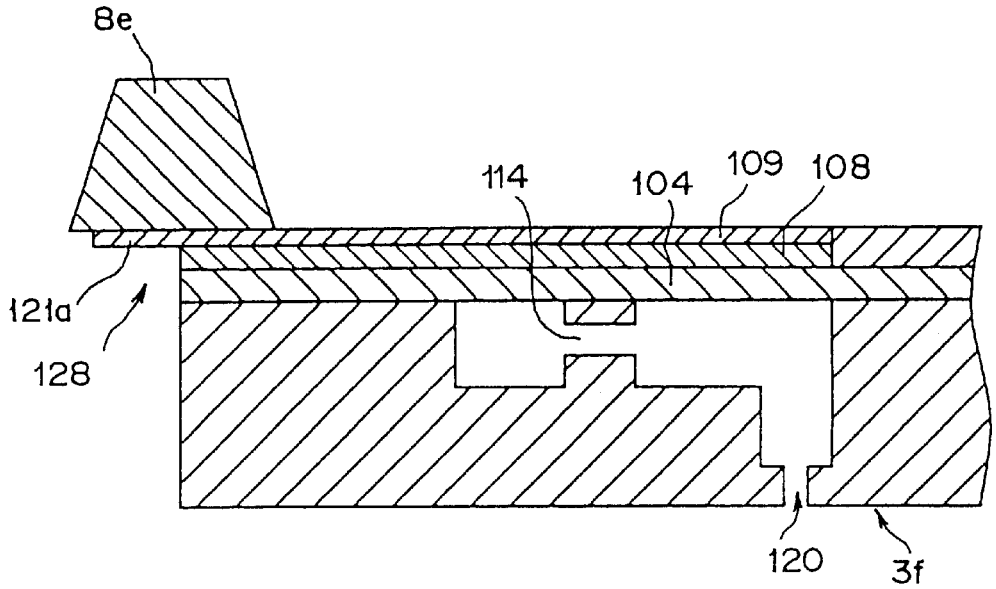
FIG. 29 is a cross sectional view taken along line A—A in FIG. 28.
Figure 30:
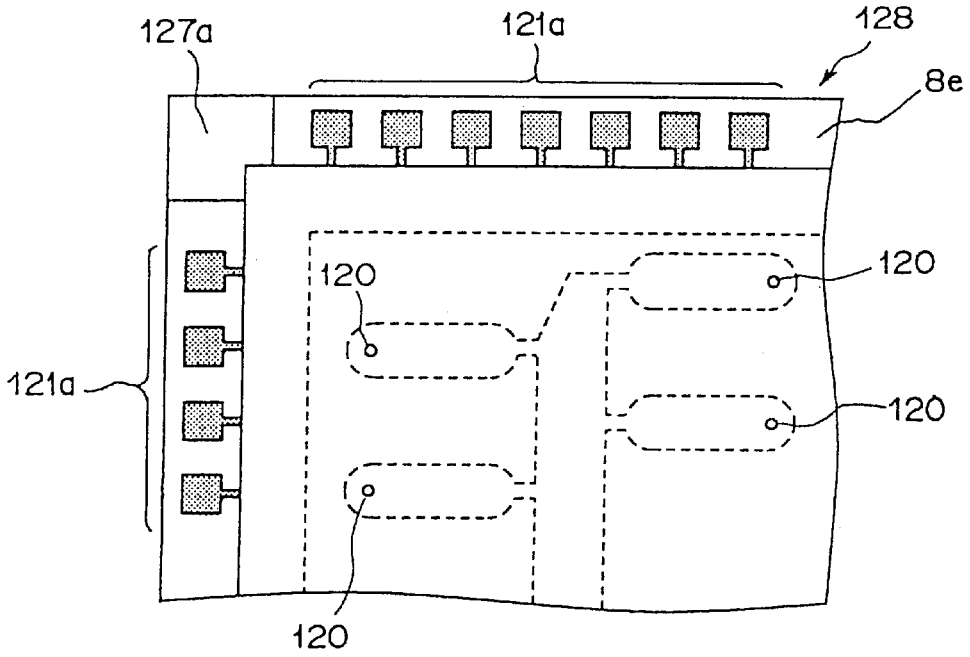
FIG. 30 is an enlarged plan view of C portion in FIG. 27.
Figure 31:
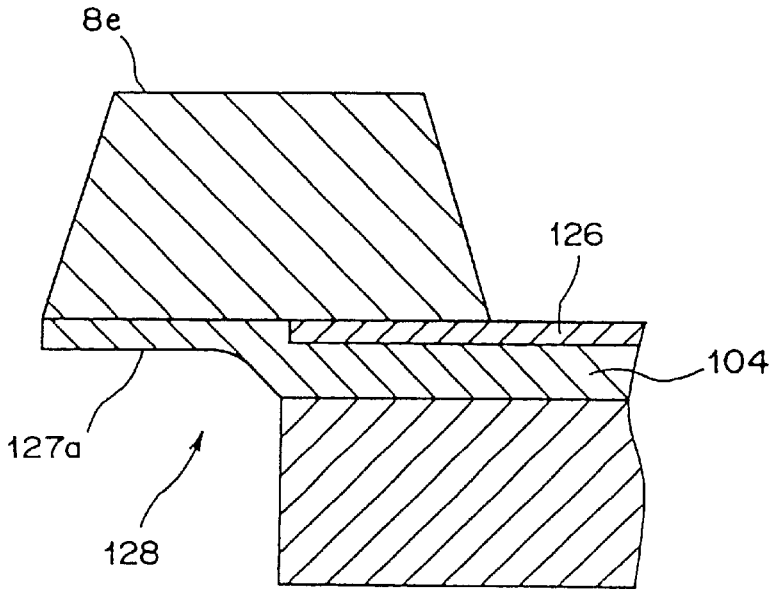
FIG. 31 is a cross sectional view taken along line B—B in FIG. 28.

FIGS. 26 through 31 are for illustrating the structure of an ink jet head according to a second embodiment of this invention. FIG. 26 is a perspective view showing the structure of a head main body of the ink jet head according to the second embodiment of this invention. FIG. 27 is a view in the direction of arrow A in FIG. 26. FIG. 28 is an enlarged plan view of B portion in FIG. 26. FIG. 29 is a cross-sectional view taken along line A—A in FIG. 28. FIG. 30 is an enlarged plan view of C portion in FIG. 27. FIG. 31 is a cross-sectional view taken along line B—B in FIG. 28.

Incidentally, like reference characters designate like or corresponding parts in the drawings, detailed descriptions of which are thus omitted.

The ink jet head 300 according to the second embodiment of this invention has a joint 8*e* instead of the joint 8*a* in the ink jet head 100*a* shown in FIGS. 15 and 16, and contacts 121 on the joint 8*e*. This structure will be now described with reference to FIGS. 26 through 31.

As shown in FIG. 26, the ink jet head 300 according to the second embodiment has a plurality of nozzles 120 which discharge ink supplied from an ink tank (an ink supply unit; not shown in FIGS. 26 through 31), like the ink jet head 100 according to the first embodiment. The ink jet head 300 also has a head main body 3*f* and a joint 8*e* as shown in FIGS. 26 through 31.

Like the above ink jet head 100, the ink jet head 300 according to the second embodiment is formed by laying a plurality of layers of dry film resists 103*a* through 103*e*, stainless steel plates 105*a* and 105*b*, etc. The layered structure of the ink jet head 300 is omitted in FIGS. 29 and 31, for the sake of convenience.

The head main body 3*f* has a pressure chamber 112, a pressure unit 140 and an ink supply channel 114 for each of the plural nozzles 120.

The joint 8*e* is formed to project from the opposite surface (on which individual electrodes 109 of the head main body 3*f* are formed) to a surface on which the nozzles 120 of the head main body 3*f* are formed, as shown in FIGS. 26 through 31. The joint 8*e* is formed to enclose the individual electrodes 109 on the surface on which the individual electrodes 109 of the head main body 3*f* are formed. Further, the joint 8*e* is formed to project outward the periphery of the head main body 3*f*, as shown in FIGS. 29 and 31.

In concrete, the joint 8*e* is formed along the periphery of the head main body 3*f* in parallel to the periphery of the same, with half of it projecting outward.

Like the joint 8*a* described above of the ink jet head 100*a* shown in FIG. 15, the joint 8*e* is formed as a remaining part of a substrate on the head main body 3*f* by partially removing the substrate made of magnesium oxide (MgO) from the head main body 3*f* in the photoetching process. An ink tank (an ink supply unit; not shown) is mounted on the joint 8*e* using an adhesive agent or the like, whereby the ink tank is mounted on the head main body 3*f*.

As shown in FIG. 29, the joint 8*e* of the ink jet head 300 according to the second embodiment has a cross-sectional shape the width of which becomes narrower as the height increases. Whereby, the adhesive forced out from the bonding surface of the ink tank is held on its slopes, thus is prevented from reaching the head main body 3*f* (the pressure units 140).

The contacts 121*a* and 127*a* are formed on a portion of the joint 8*e* projecting outward from the periphery of the head main body 3*f*, on the opposite surface (hereinafter referred as a contact forming surface 128) to a surface on which the ink tank is mounted.

According to the second embodiment, a contact 127*a* is formed in each corner on the contact forming surface 128. These contacts 127*a* are integrally formed with a vibrating plate 104, as shown in FIG. 31.

A plurality of contacts 121*a* are formed between the contacts 127*a* on the contact forming surface 128. Incidentally, the contact 121*a* is formed for each of the individual electrodes 109.

Note that positions of the contacts 121*a* and 127*a* are not limited to the above example, but may be modified in various ways without departing from the scope of the invention.

The contact 121*a* and the individual electrode 109 are electrically connected by a wiring pattern 123 formed into a thin film.

According to the second embodiment, the contacts 121*a* are arranged on the outer side of the periphery of the head main body 3*f* on the side of the joint 8*e*. The contacts 121*a* formed for the respective individual electrodes 109 are disposed on the contact forming surface 128 of the joint 8*e*, and an FPC 2 supplying a signal for controlling each of the pressure units 140 is electrically connected to the contacts 121*a* using a technique of TAB or the like.

In the above structure, the FPC is electrically connected to the contacts 121*a* and 127*a* using a technique of TAB or the like, as shown in FIG. 27, after that, a drive signal is supplied from a drive circuit not shown to each of the individual electrodes 109 via the FPC, whereby the pressure unit 140 applies pressure to the pressure chamber 112 to discharge ink from the nozzle 120.

The ink jet head 300 according to the second embodiment of this invention can electrically connect the FPC which supplies a signal for controlling the pressure unit 140 to each of the individual electrodes 109 without having an effect of the joint 8*e* when the individual electrode 109 and the contact 121*a* are electrically connected, which can thus provide the similar functions and effects to those provided by the above ink jet head 100*a* according to the first modification of the first embodiment. Additionally, it is possible to form the head main body 3*f* in which the nozzles 120 are formed smaller than the joint 8*e,* which allows the size of the ink jet head 300 to be reduced.

Since the height of the contact 121*a* can be equal to that of the contact 127*a* on the contact forming surface 128 when the FPC 2 is connected to the contacts 121*a* and 127*a,* it is possible to electrically connect them certainly in connecting the FPC 2.

Since the contact forming surface 128 is applied pressure from the upper surface of the FPC 2 when the FPC 2 is pressed onto the contacts 121*a* and 127*a* to be connected thereto, the joint 8*e* having high rigidity can support the contact forming surface 128, which leads to improvement of the fabrication stability.

(H) Description of Third Embodiment

Figure 32:
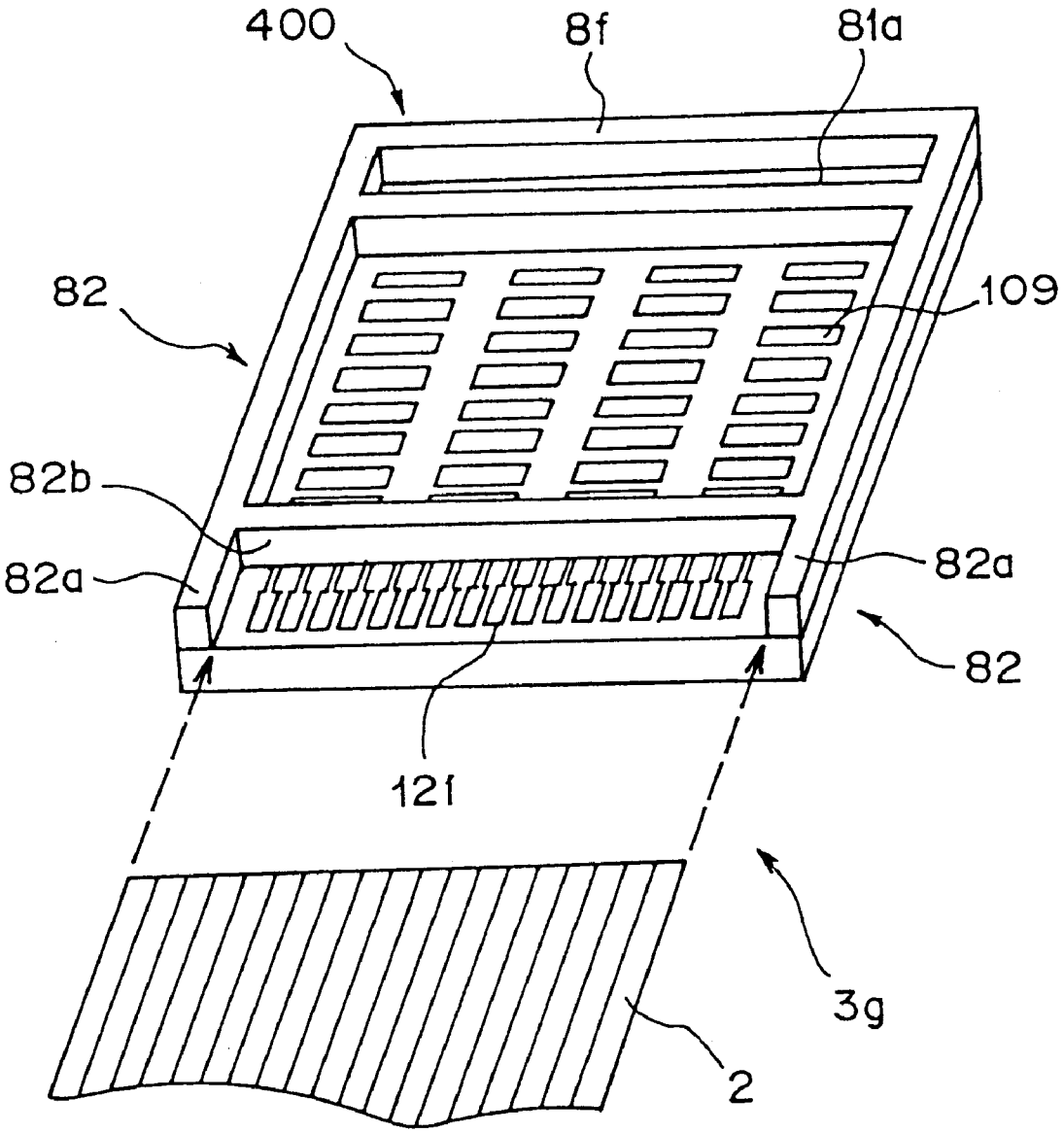
FIG. 32 is a perspective view showing the structure of a head main body of an ink jet head according to a third embodiment of this invention.

FIG. 32 is a perspective view of the structure of a head main body of an ink jet head according to a third embodiment of this invention. Like the above-described ink jet head 100*a* according to the first modification, the ink jet head 400 according to the third embodiment of this invention has a plurality of nozzles (not shown) which discharge ink supplied from an ink tank (an ink supply unit; not shown), as shown in FIG. 32. The ink jet head 400 also has a head main body 3*g* and a joint 8*f.*

Incidentally, like reference characters designate like or corresponding parts in the drawings, detailed descriptions of which are thus omitted.

The joint 8*f* is formed to project from a surface (on the upper side in FIG. 32) opposite to a surface on which the nozzles of the head main body 3*g* are formed. The joint 8*f* is formed to enclose individual electrodes 109 on a surface on which the individual electrodes 109, contacts 121 and wiring patterns 123 of the head main body 3*g* are formed.

The joint 8*f* is formed as a remaining part of a substrate made of magnesium oxide (MgO) by partially removing the substrate from the head main body 3*g* in the photoetching process. An ink tank (an ink supply unit) or an ink tank fixing member is mounted on the joint 8*f* using an adhesive agent or the like, whereby the ink tank 50 is mounted on the head main body 3*g*.

The joint 8*f* has a cross-sectional shape the width of which becomes narrower as the height increases. The adhesive agent forced out from the bonding surface of the ink tank 50 is held by the slopes, so that the adhesive agent forced out is prevented from reaching the head main body 3*g*.

In the joint 8*f,* a pair of members opposite to each other among members forming the joint 8*f* horizontally project in the same direction, thereby forming a positioning unit 82. Hereinafter, the pair of members projecting from the joint 8*f,* which form the positioning unit 82, will be referred as projecting units, denoted by reference numeral 82*a.*

The positioning unit 82 is configured with the projecting units 82*a* and an outer peripheral surface 82*b* in a portion where the projecting units 82*a* of the joint 8*f* are formed.

A plurality of contacts 121 and 127 are formed on a surface on which individual electrodes 109, wiring patterns 123, etc. of the head main body 3*g* are formed, outside the joint 8*f,* between the pair of projecting units 82*a.*

In the above structure, an end surface of an FPC (an external connection wiring member) 2 is brought into contact with the outer peripheral surface 82*b* between the pair of projecting units 82*a,* positioned to the contacts 121, then electrically connected to the contacts 121 and 127 using the TAB technique.

In the ink jet head 400 according to the third embodiment of this invention, an end surface of the FPC 2 is brought into contact with the outer peripheral surface 82*b* between the pair of projecting units 82*a,* so that the FPC 2 is positioned to the contacts 121. The FPC 2 and the contacts 121 and 127 can be thereby electrically connected certainly. Additionally, since parts exclusively used to position the FPC 2 become unnecessary, it is possible to decrease the number of parts configuring the ink jet head 400.

(I) Description of Fourth Embodiment

Figure 33:
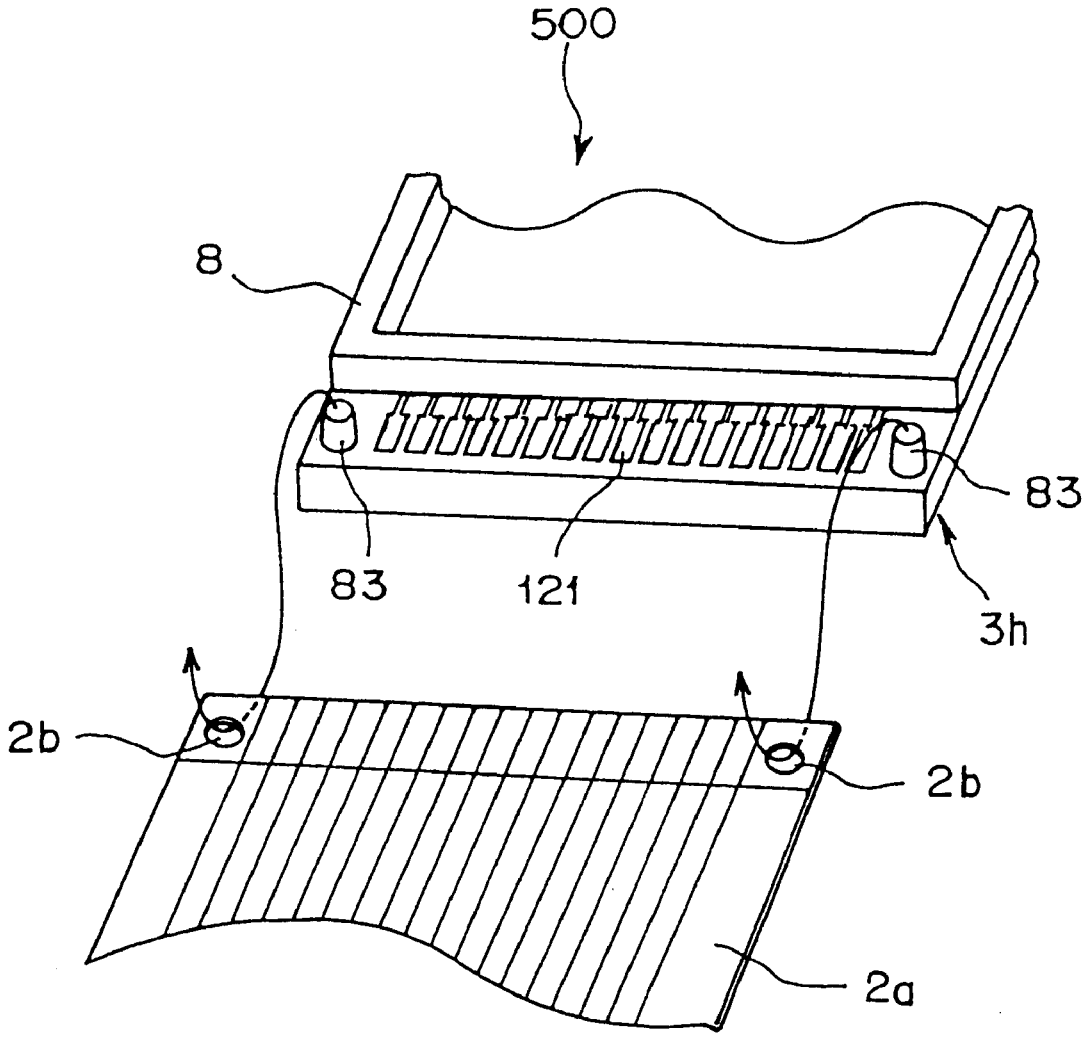
FIG. 33 is a perspective view showing the structure of an essential part of an ink jet head according to a fourth embodiment of this invention.
Figure 34:
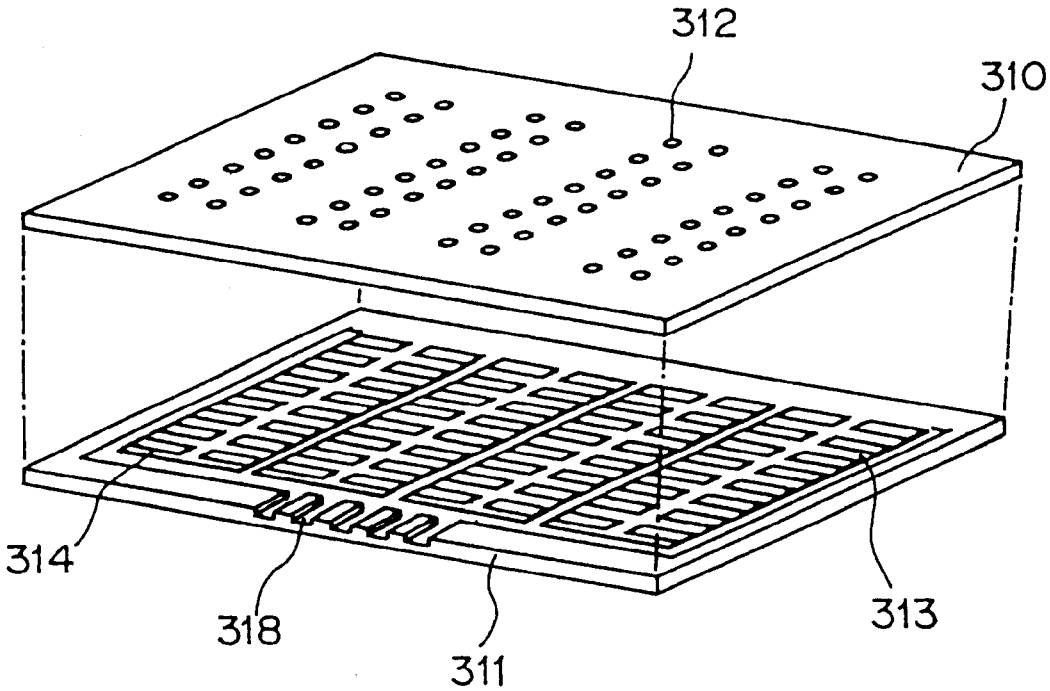
FIG. 34 is an exploded perspective view in order to illustrate the structure of essential parts of a known ink jet head.
Figure 35:
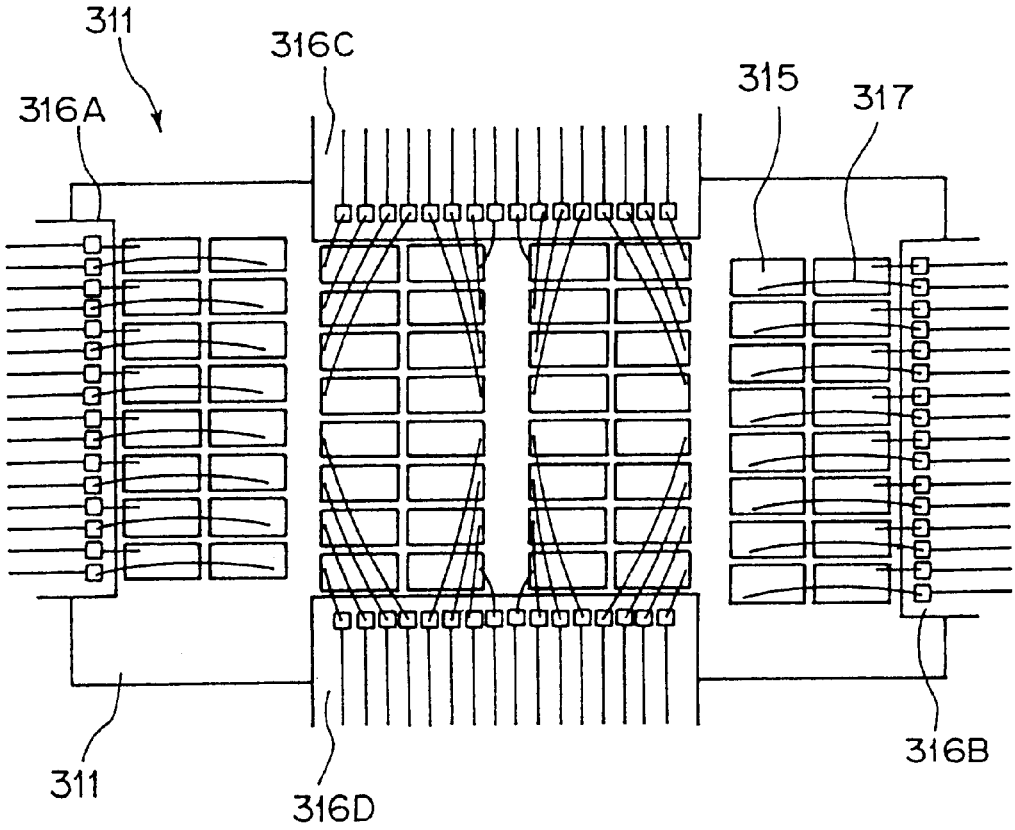
FIG. 35 is a diagram for illustrating a method of wiring in the known ink jet head.

FIG. 33 is a perspective view showing the structure of an essential part of an ink jet head according to a fourth embodiment of this invention. The ink jet head 500 according to the fourth embodiment has a plurality of nozzles (not shown) which discharge ink supplied from an ink tank (an ink supply unit; not shown), like the above-described ink jet head 400 according to the fourth embodiment. The ink jet head 500 also has a head main body 3*h* and a joint 8, as shown in FIG. 33.

Incidentally, like reference characters designate like or corresponding parts in the drawings, detailed description of which are thus omitted.

As shown in FIG. 33, the ink jet head 500 according to the fourth embodiment has a joint 8 instead of the joint 8*f* in the ink jet head 400 shown in FIG. 32, along with positioning units 83.

A pair of the positioning units 83 each of which has an approximately cylindrical shape are formed in corners of at least one side among sides forming the periphery of the head main body 3*h,* outside the joint 8, on a surface on which individual electrodes 109, wiring patterns 123, etc. are formed. Between the pair of positioning units 83 formed are a plurality of contacts 121 and 127.

Positioning holes 2*b* each having almost the identical cross-sectional shape to that of the positioning unit 83 are formed in the vicinity of an end of an FPC 2*a,* at positions corresponding to those of the above pair of positioning units 83.

In the above structure, the positioning units 83 are fitted into the positioning holes 2*b* formed in the FPC (an external connection wiring member) 2*a,* respectively, to position the FPC 2*a* to the contacts 121 and 127, the FPC 2*a* is then electrically connected to the contacts 121 and 127 using the TAB technique.

As above, in the ink jet head 500 according to the fourth embodiment of this invention, the positioning units 83 are fitted into the positioning holes 2*b* formed in the FPC 2*a* to position the FPC 2*a* to the contacts 121 and 127, whereby the FPC 2*a* and the contacts 121 and 127 can be certainly electrically connected.

(j) Others

Note that the present invention is not limited to the above embodiments, but may be modified in various ways without departing from the scope of the invention.

For example, the above ink jet head 100 according to the first embodiment is formed by joining three layers of (A) layer to (C) layer. The ink jet head 100 is not limited to this example, but may be formed by joining, for example, two layers, or an arbitrary number of layers.

In the above first embodiment, (B) layer is configured with three layers (excluding the adhesive layer), (C) layer is configured with five layers, and the stainless steel plates 105*a* are laid. However, the present invention is not limited to this example, but (B) layer or (C) layer may be configured with a desired number of layers, and each of the layers may be of a desired thickness.

In the above first embodiment, the stainless steel plate 105*a* is joined on the dry film resist 103*c.* However, this invention is not limited to this example, but the stainless steel plate 105*a* may be formed on the dry film resist 103*d* in (B) layer.

A member made of a resin such as PEN or the like, or a composite resin such as FRP or the like, other than metals or ceramics, may be disposed instead of the stainless steel plate 105*a*. When these members are used to configure the layer, it is possible to decrease the thermo residual stress in the heating treatment at the time of joining or the like since these member have a similar thermal expansion coefficient to other dry film resists 103, which leads to improvement of the quality of the ink jet head.

Each of the contacts 121 and 127, and the FPC 2 (2*a*) are connected using the TAB technique. However, this invention is not limited to this example, but may be modified in various ways.

In the ink jet head 100 (10*d*, 100*e*, 400, 500) in the fourth and fifth modifications of the first embodiment, the second embodiment, the third embodiment and the fourth embodiment, the shape of the joint 8 (8*b*, 8*c*, 8*e*, 8*f*) or the shape of the ink common channel 110 (10*b*) are not limited to the examples, but may be modified in various ways.

In the first and second modifications of the first embodiment, the second embodiment and the third embodiment, the shape of the wiring pattern 123 is not limited to the examples, but the wiring pattern 123 may have the shape of the wiring pattern 123 shown in the fourth modification or the fifth modification of the ink jet head of the first embodiment.

Note that persons skilled in the art can fabricate so long as each of the embodiments of this invention is disclosed.

INDUSTRIAL APPLICABILITY

According to the ink jet head and the printing apparatus according to this invention facilitates connection of the individual electrode of each of the pressure unit for each nozzle to the external connection wiring member, improves the integration of the head main body, thus reduces the size thereof. Therefore, the present invention can be applied to an ink jet head of a printing apparatus with an ink jet head.

What is claimed is:

1. An ink jet head having a plurality of nozzles (120) discharging ink supplied from an ink supply unit (50) comprising:

a head main body (3) including a plurality of pressure chambers (112), provided one for each of said nozzles (120), in which ink is filled, and a plurality of pressure units (140), provided one for each of said pressure chambers (112), each of said pressure units (140) applying pressure to said pressure chamber (112) to discharge the ink in said pressure chamber (112) from said nozzle (120);

an individual electrode (109) provided for each of said pressure units (140) to drive said pressure unit (140);

a joint (8) formed to enclose said individual electrode (109);

at least one contact (121) connected to an external connection wiring member (2) supplying a signal for controlling said pressure unit (140), wherein said at least one contact (121) is disposed outside said joint (8); and a wiring pattern (123) formed into a thin film to electrically connect said individual electrode (109) to said contact (121).

2. The ink jet head according to claim 1, wherein said individual electrode (109), said contact (121) and said wiring pattern (123) are integrally formed into said thin film on the same surface from the same material.

3. The ink jet head according to claim 1 or 2 wherein said joint (8) is formed to project from said head main body (3) so that said ink supply unit (50) is mounted to said head main body (3).

4. The ink jet head according to claim 3, wherein said head main body (3) is formed on a substrate (122), and said joint (8) is formed as a remaining part of said substrate (122) on said head main body (3) by partially removing said substrate (122) from said head main body (3).

5. The ink jet head according to claim 1 or 2, wherein said external connection wiring member (2) is an FPC (Flexible Printed Circuit Board), and is electrically connected to said contact (121) by the use of a TAB (Tape Automated Bonding) technique.

6. The ink jet head according to claim 1 or 2, wherein said pressure unit (140) comprises said individual electrode (109), a vibrating plate (104) forming a part of said pressure chamber (112) and a piezoelectric element (108) driving said vibrating plate (104) to apply pressure to said pressure chamber (112).

7. An ink jet head having a plurality of nozzles (120) discharging ink supplied from an ink supply unit (50) comprising:

a head main body (3) including a plurality of pressure chambers (112), provided one for each of said nozzles (120), in which ink is filled, and a plurality of pressure units (140), provided one for each of said pressure chambers (112), each of said pressure units (140) applying pressure to said pressure chamber (112) to discharge the ink in said pressure chamber (112) from said nozzle (120);

an individual electrode (109) provided for each of said pressure units (140) to drive said pressure unit (140);

at least one contact (121) connected to an external connection wiring member (2) supplying a signal for controlling said pressure unit (140);

a wiring pattern (123) formed into a thin film to electrically connect said individual electrode (109) to said contact (121); and a joint (8) formed to project from said head main body (3) so that said ink supply unit (50) is mounted to said head main body (3), wherein said head main body (3) is formed on a substrate (122), and said joint (8) is formed as a remaining part of said substrate (122) on said head main body (3) by partially removing said substrate (122) from said head main body (3), wherein said joint (8) is formed to enclose said individual electrodes (109) on a surface on which said individual electrodes (109), said contacts (121) and said wiring patterns (123) are formed; and said contacts (121) are disposed outside said joint (8).

8. The ink jet head according to claim 7, wherein said joint (8) functions as a positioning unit (82, 83) positioning said external connection wiring member (2) to said contact (121).

9. The ink jet head according to claim 8, wherein positioning of said external connection wiring member (2) to said contact (121) is performed by fitting an end surface of said external connection wiring member (2) to an outer peripheral surface of said joint (8).

10. The ink jet head according to claim 7, wherein a positioning unit (82, 83) for positioning said external connection wiring member (2) to said contact (121) is formed as a remaining part of said substrate (122) on said head main body (3) by partially removing said substrate (122) from said head main body (3).

11. The ink jet head according to claim 10, wherein positioning of said external connection wiring member (2) to said contact (121) is performed by fitting said positioning unit (83) into at least one positioning hole (2*b*) formed on the side of said external connection wiring member (2).

12. An ink jet head having a plurality of nozzles (120) discharging ink supplied from an ink supply unit (50) comprising:

a head main body (3) including a plurality of pressure chambers (112), provided one for each of said nozzles (120), in which ink is filled, and a plurality of pressure units (140), provided one for each of said pressure chambers (112), each of said pressure units (140) applying pressure to said pressure chamber (112) to discharge the ink in said pressure chamber (112) from said nozzle (120);

an individual electrode (109) provided for each of said pressure units (140) to drive said pressure unit (140);

at least one contact (121) connected to an external connection wiring member (2) supplying a signal for controlling said pressure unit (140);

a wiring pattern (123) formed into a thin film to electrically connect said individual electrode (109) to said contact (121); and a joint (8) formed to project from said head main body (3) so that said ink supply unit (50) is mounted to said head main body (3), wherein said head main body (3) is formed on a substrate (122), and said joint (8) is formed as a remaining part of said substrate (122) on said head main body (3) by partially removing said substrate (122) from said head main body (3), wherein said joint (8) is formed to enclose said individual electrodes (109) on a surface on which said individual electrodes (109) are formed, and to project outward from a periphery of said head main body (3); and said contacts (121) are arranged outside the periphery of said head main body (3) on the side of said joint (8).

13. A printing apparatus comprising an ink jet head including:

a plurality of nozzles (120) discharging ink supplied from an ink supply unit (50);

a head main body (3) including a plurality of pressure chambers (112) provided for said nozzles (120), respectively, in which ink is filled, and a plurality of pressure units (140) provided for said pressure chambers (112), respectively, each of said pressure units (140) applying pressure to said pressure chamber (112) to discharge the ink in said pressure chamber from said nozzle (120);

an individual electrode (109) provided for each of said pressure units (140) to drive said pressure unit (140);

a joint (8) formed to enclose said individual electrode (109);

at least one contact (121) connected to an external connection wiring member (2) supplying a signal for controlling said pressure unit (140), wherein said at least one contact (121) is disposed outside said joint (8); and a wiring pattern (123) formed into a thin film to electrically connect said individual electrode (109) to said contact (121).

14. An ink jet head having a plurality of nozzles (120) discharging ink supplied from an ink supply unit (50) comprising:

a head main body (3) including a plurality of pressure chambers (112), provided one for each of said nozzles (120), in which ink is filled, and a plurality of pressure units (140), provided one for each of said pressure chambers (112), each of said pressure units (140) applying pressure to said pressure chamber (112) from said nozzle (120);

an individual electrode (109) provided for each of said pressure units (140) to drive said pressure unit (140);

at least one contact (121) connected to an external connection wiring member (2) supplying a signal for controlling said pressure unit (140);

a wiring pattern (123) formed into a thin film to electrically connect said individual electrodes (109) to said contact (121); and a joint (8) formed to project form said head main body (3) so that said ink supply unit (50) is mounted to said head main body (3), wherein said joint (8) is formed to enclose said individual electrode (109) on a surface on which said individual electrodes (109) are formed, and to project outward from, and to project outward from a periphery of said head main body (3); and said contact (121) are arranged outside the periphery of said head main body (3) on the side of said joint.

15. The ink jet head according to claim 14, wherein said individual electrode (109), said contact (121) and said wiring pattern (123) are integrally formed into said thin film on the same surface from the same material.

16. The ink jet head according to claim 14, wherein said head main body (3) is formed on a substrate (122), and said joint (8) is formed as a remaining part of said substrate (122) on said head main body (3) by partially removing said substrate (122) from said head main body (3).

17. The ink jet head according to claim 16, wherein said joint (8) is formed to enclose said individual electrodes (109) on a surface on which said individual electrodes (109), said contacts (121) and said wiring patterns (123) are formed; and said contacts (121) are disposed outside said joint (8).

18. The ink jet head according to claim 17, wherein said joint (8) functions as a positioning unit (82, 83) positioning said external connection wiring member (2) to said contact (121).

19. The ink jet head according to claim 18, wherein positioning of said external connection wiring member (2) to said contact (121) is performed by fitting an end surface of said external connection wiring member (2) to an outer peripheral surface of said joint (8).

20. The ink jet head according to claim 17, wherein a positioning unit (82, 83) for positioning said external connection wiring member (2) to said contact (121) is formed as a remaining part of said substrate (122) on said head main body (3) by partially removing said substrate (122) from said head main body (3).

21. The ink jet head according to claim 20, wherein positioning of said external connection wiring member (2) to said contact (121) is performed by fitting said positioning unit (83) into at least one positioning hole (2*b*) formed on the side of said external connection wiring member (2).

22. The ink jet head according to any one of claims 11 through 21, wherein said external connection wiring member (2) is an FPC (Flexible Printed Circuit Board), and is electrically connected to said contact (121) by the use of a TAB (Tape Automated Bonding) technique.

23. The ink jet head according to any one of claims 14 through 22, wherein said pressure unit (140) comprises said individual electrode (109), a vibrating plate (104) forming a part of said pressure chamber (112) and a piezoelectric element (108) driving said vibrating plate (104) to apply pressure to said pressure chamber (112).

* * * * *